US007434376B2

(12) United States Patent
Monti

(10) Patent No.: US 7,434,376 B2
(45) Date of Patent: Oct. 14, 2008

(54) MACHINE FOR PACKAGING ARTICLES INTO BOX-LIKE CONTAINERS

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 11/951,375

(22) Filed: Dec. 6, 2007

(65) Prior Publication Data

US 2008/0141632 A1 Jun. 19, 2008

(30) Foreign Application Priority Data

Dec. 19, 2006 (IT) ..... BO2006A0859

(51) Int. Cl.
*B65B 43/26* (2006.01)

(52) U.S. Cl. ..... 53/564; 53/566; 53/573; 493/122; 493/390; 493/313

(58) Field of Classification Search ..... 53/564, 53/566, 573, 458, 467; 493/122, 123, 126, 493/127, 309, 313
See application file for complete search history.

(56) References Cited

U.S. PATENT DOCUMENTS 5,115,625 A * 5/1992 Barbulesco et al. ..... 53/467
5,916,079 A * 6/1999 Haring et al. ..... 493/125
5,957,825 A * 9/1999 Marchetti ..... 493/313
6,510,670 B1 * 1/2003 Janhonen ..... 53/209
6,669,616 B1 * 12/2003 Bierenacki et al. ..... 493/316
7,131,941 B2 * 11/2006 Makar et al. ..... 493/309
7,219,485 B2 * 5/2007 Battisti ..... 53/542
7,311,650 B2 * 12/2007 Makar et al. ..... 493/309
7,390,291 B2 * 6/2008 Chiu Chen ..... 493/313

FOREIGN PATENT DOCUMENTS

| | | |
|---|---|---|
| EP | 1 780 128 A | 5/2007 |
| GB | 2 171 975 A | 9/1986 |
| WO | WO 96/07592 | 3/1996 |
| WO | WO 98/57857 | 12/1998 |

* cited by examiner

*Primary Examiner*—Hemant M Desai
(74) *Attorney, Agent, or Firm*—William J. Sapone; Coleman Sudol Sapone P.C.

(57) ABSTRACT

In a machine for packaging articles into box-like containers, obtained from tubular blanks in flat folded configuration, tubular blanks are conveyed from a feeding station to an erecting station, by an erection unit, moving between the erecting station and a station for vertical introduction of articles into the erected blanks. A folding element cooperates with the unit to fold a second lower flap of the blank by ninety degrees. A horizontal plane supports the blank and articles contained in the blank. The blank is transferred and guided on the horizontal plane while blank flaps are folded. At closing stations a bottom and a cover of the so obtained pack are closed.

43 Claims, 16 Drawing Sheets

M

143
E2
141
144
140
142
E1
1
110
152A
115
Y1
153
115
130
100
1
152B
150
1W

FIG.10
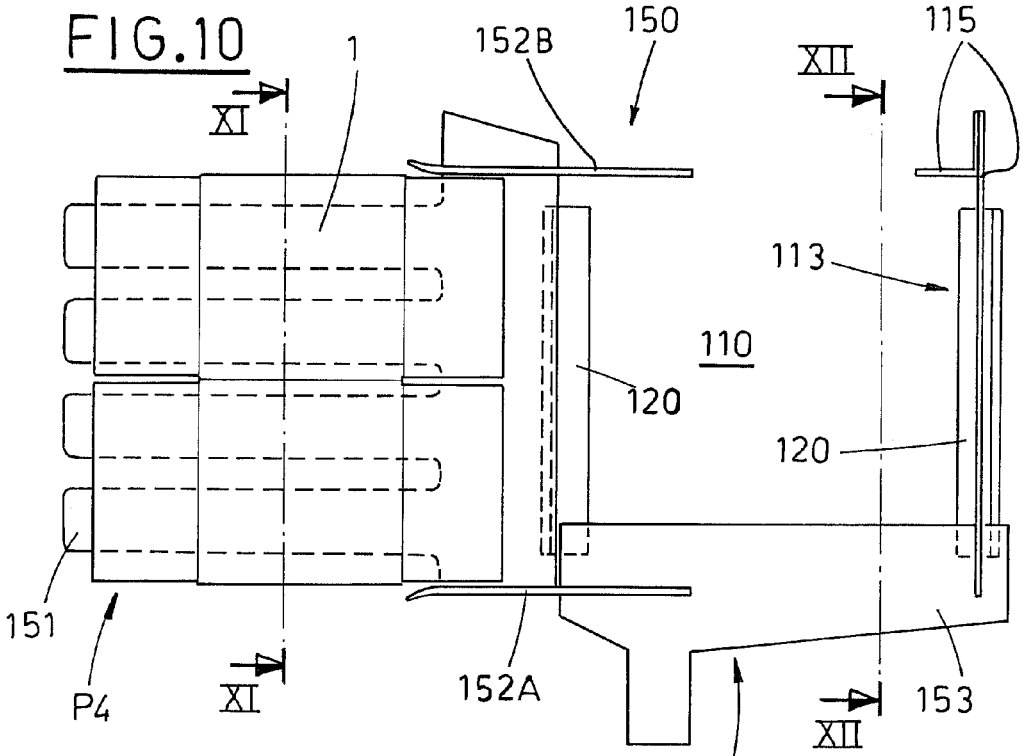
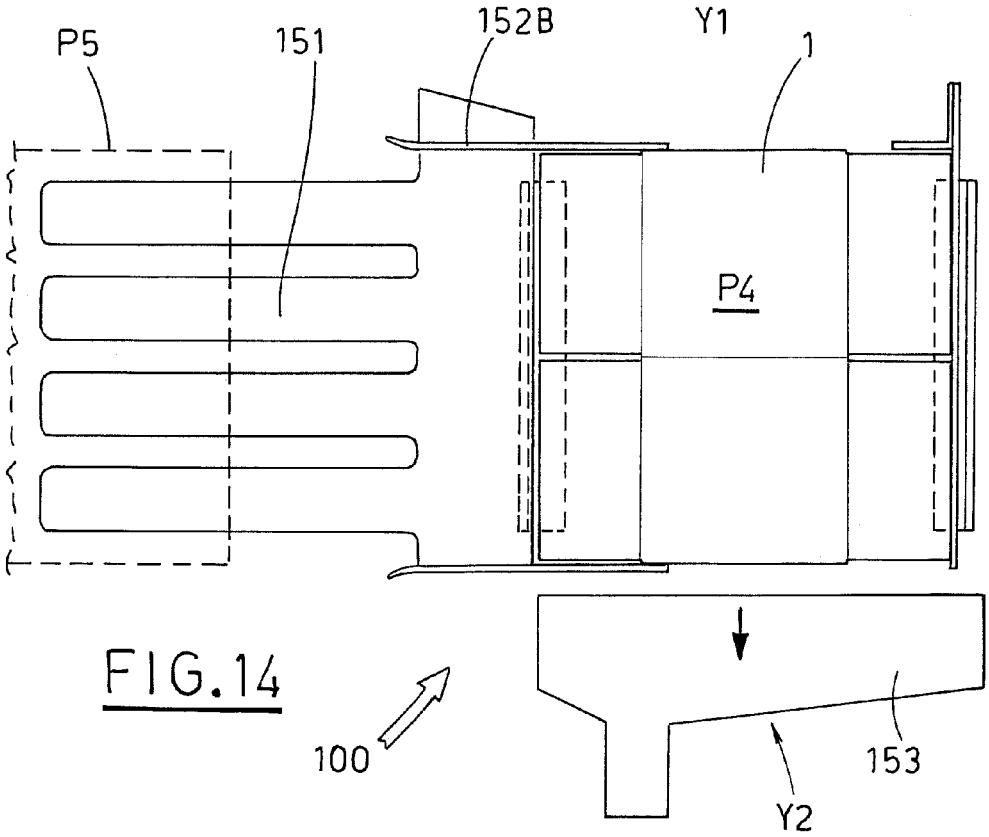
FIG.14

FIG.11
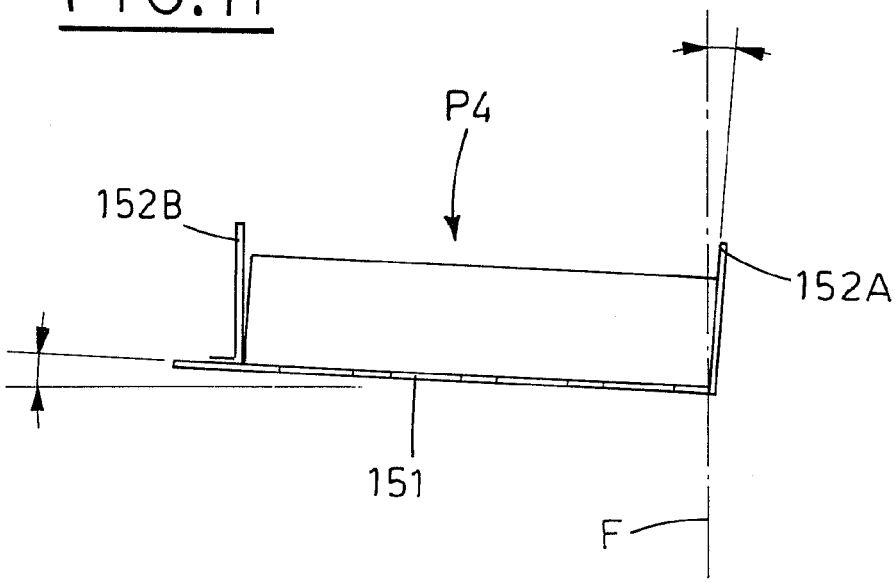
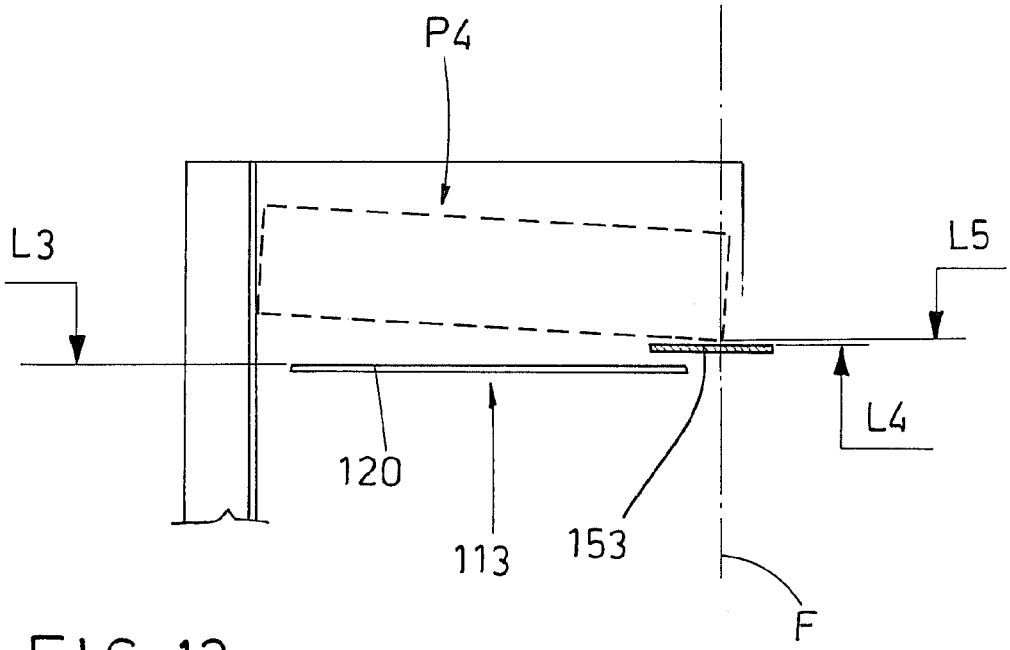
FIG.12

FIG. 19A
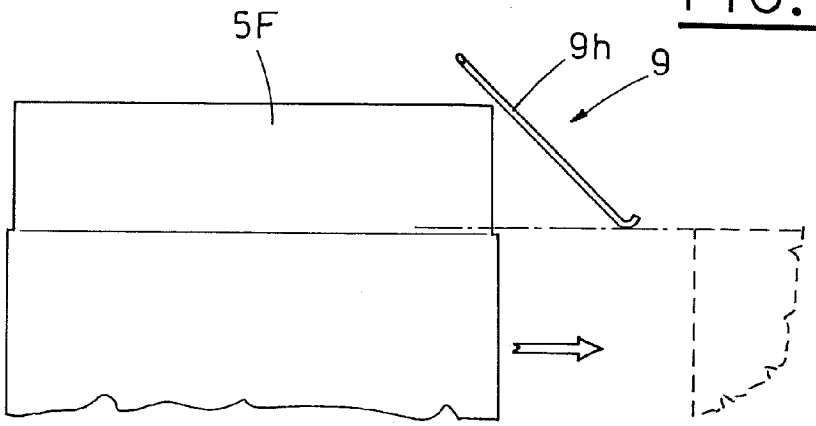
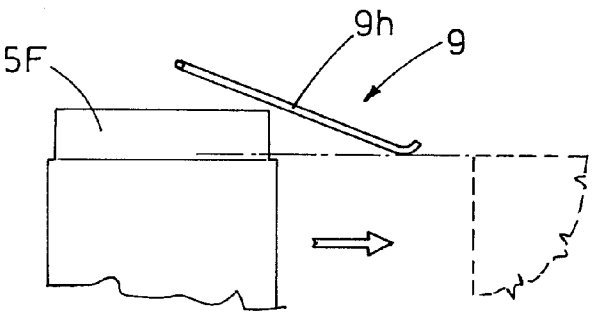
FIG. 19B
FIG. 18A
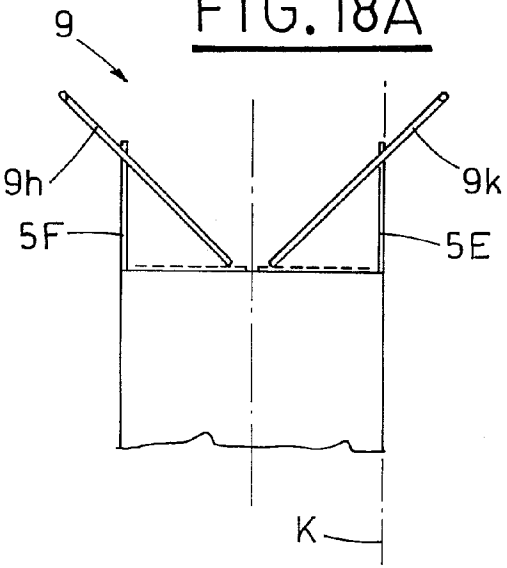
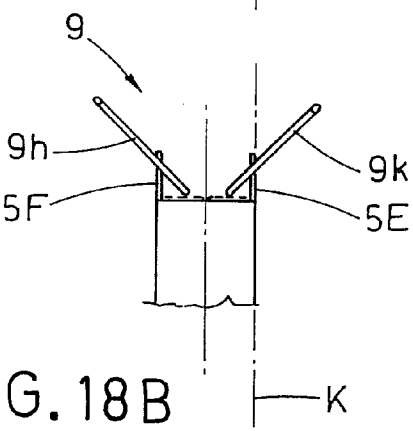
FIG. 18B

MACHINE FOR PACKAGING ARTICLES INTO BOX-LIKE CONTAINERS

FIELD OF THE INVENTION

The present invention relates to boxing machines, in particular for packaging articles into box-like containers.

BACKGROUND OF THE INVENTION

As it is known, boxing machines are designed for boxing articles or packs of articles of different kind (that is, more commonly, for packaging articles into box-like containers); in general and qualitative terms, the operations, that follow one another in similar machines include: picking up a flat folded tubular blank from a containing magazine, erecting the blank, so that it assumes a parallelepiped shape of rectangular section and vertical (horizontal) axis, introduction of articles or packs of articles into the erected blank, in vertical (horizontal) direction, folding the blank flaps and their mutual sealing, so as to define the bottom and a cover of a corresponding box of articles. It is understood that some of these operations can be performed in a different order than the cited one, or include more phases (for example, it is possible that first the flaps forming the box bottom are folded, then the articles are introduced into the erected blank and next, the flaps defining the box cover are folded), according to the type of the machine.

It is known in the boxing machines, that cross-section of the box to be obtained is rectangular, and in some cases even square.

In the last case, it occurs in the feeding station magazine that the diagonally opposite pre-creasing lines in flat configuration, situated at the blank center, are exactly one over another, unlike in the rectangular section case, in which they are shifted.

For this reason, the blanks are less resistant to bending, therefore the ones placed in the lower part of the stack can lose the planarity and assume a curved downward conformation, due to the weight resting on them.

These drawbacks are amplified by increasing dimensions, and consequently weight, of the blanks.

In boxing machines of known type, which include the introduction of articles in vertical direction, the square blank is usually taken to the filling station by conveying means, which are aimed at maintaining, no matter of how the size changes, the bottom and the longitudinal medium line in alignment with two corresponding stationary planes, one horizontal and the other vertical. In this way, manipulating means, aimed at introducing the articles into the boxes being formed and working in a position corresponding to the filling station, perform vertical strokes having constant maximum width, independently from the dimensions of the containers being used. Consequently, a production rate, which can be accepted for boxes of large dimensions, does not imply satisfying filling times for boxes of minimum dimensions, or anyway smaller, for which a higher production rate is normally expected.

SUMMARY OF THE INVENTION

Therefore, the main object of the present invention is to solve successfully the above mentioned disadvantages, by conceiving a machine, that allows to reduce substantially the time necessary for the introduction of the articles into the erected blanks, especially for small sizes, obtaining in this way a more favorable production rate with respect to the solutions of known type.

Another object of the invention is to propose a machine, whose station for feeding flat folded tubular blanks is provided with working means, capable of operating in best way also with blanks shaped to form square-section boxes, independently from the blanks size and weight, and which can store a considerable number of blanks, so as to offer high operation autonomy.

A further object of the invention is to create a newly conceived machine for packaging articles into box-like containers, made in such a way, as to allow the operator's constant visual control of the box-like containers being formed (erecting of the tubular blank), filled and closed, making also simple and immediate a possible direct servicing for the stations, in which these steps are carried out. Moreover, the machine being considered must be reliable, have an essential structure, high productivity at relatively low costs in comparison with the results to be obtained.

The above mentioned objects are obtained, in accordance with the contents of the claims, by a machine for packaging articles in box-like containers, each container being obtained from a tubular blank formed by an upper sheet and a lower sheet, defining a flat folded configuration, each tubular blank having also longitudinal pre-creasing lines for facilitating folding and erection of the blank to take a substantially parallelepiped shape, as well as transversal pre-creasing lines for, in turn, facilitating folding of flaps of the container, the machine including:

an in-depth storage magazine containing at least one blank stack formed by a selected number of flat folded tubular blanks, arranged horizontal;

first openable support means for supporting said blank stack;

a vertically movable platform situated below said in-depth storage magazine for receiving, when located at a relevant raised loading position, said blank stack released by said first openable support means, said platform being subsequently lowered, together with said blank stack, to a waiting position;

picking up means, moving horizontally between two extreme positions, namely a first position defined above said blank stack resting on said platform and, in step relation with a calibrated raising of the platform, for picking up a topmost blank of said stack, followed by a platform lowering to said waiting position, and a second position define out of said platform, to deliver the topmost blank to a blank erecting station;

a mobile unit moving between said erecting station and a station for vertical introduction of said articles into erected tubular blanks (1), and aimed at erecting each tubular blank, so as to define a parallelepiped rectangular shape with a vertical axis, as well at folding, by a ninety degree angle, a first lower flap, situated backward with respect to a predetermined forwarding direction of said tubular blank toward said filling station;

a folding member, situated near the filling station for folding a second lower flap of the blank, by a ninety degree angle, opposite to said first lower flap and situated at a front side with respect to said forwarding direction, said folding being performed in time relation with blank arrival at said filling station;

a horizontal plane for supporting a tubular blank reaching said filling station and a relevant article, introduced into the blank vertically by associated manipulating means, the blank resting on said first flap and said second lower flap sliding on said horizontal plane;

guiding and moving means for guiding and moving said tubular blank along said horizontal plane in a direction concurrent to said forwarding direction, from said filling station to folding means for folding lower lateral flaps, upper fore and rear flaps, and lateral flaps of said tubular blank, as well as to stations for closing bottom and cover of a so obtained box-like container, said guiding and moving means including endless conveying means, operated by actuator means in step relation with motion of said erecting and folding unit and with vertical introduction of articles into the erected blank, said conveying means facing at least one longitudinal portion of two opposite lateral walls of the blank with respect to the forwarding direction, and having also lateral protrusions for striking corresponding portions of a blank rear wall, moving the container in the forwarding direction.

BRIEF DESCRIPTION OF THE DRAWINGS

The characteristic features of the invention, not appearing from what has been just said, will be better pointed out in the following, in accordance with the contents of claims and with help of the enclosed figures, in which:

FIG. 10 is a top view of FIG. 9;

FIG. 11 is a section view, taken along the plane XI-XI of FIG. 10;

FIG. 12 is a section view, taken along the plane XII-XII of FIG. 10;

FIG. 14 is a top view of FIG. 13;

FIGS. 18A-19A are front and lateral views of a fourth detail of FIG. 1, that is means for folding the upper lateral flaps of an erected blank with maximum size, and an upper portion of the latter, respectively;

FIGS. 18B-19B are front and lateral views, respectively, of the fourth detail of FIG. 1, that is means for folding the upper lateral flaps of an erected blank with minimum size, and an upper portion of the latter.

DISCLOSURE OF THE PREFERRED EMBODIMENTS

Figure 1:
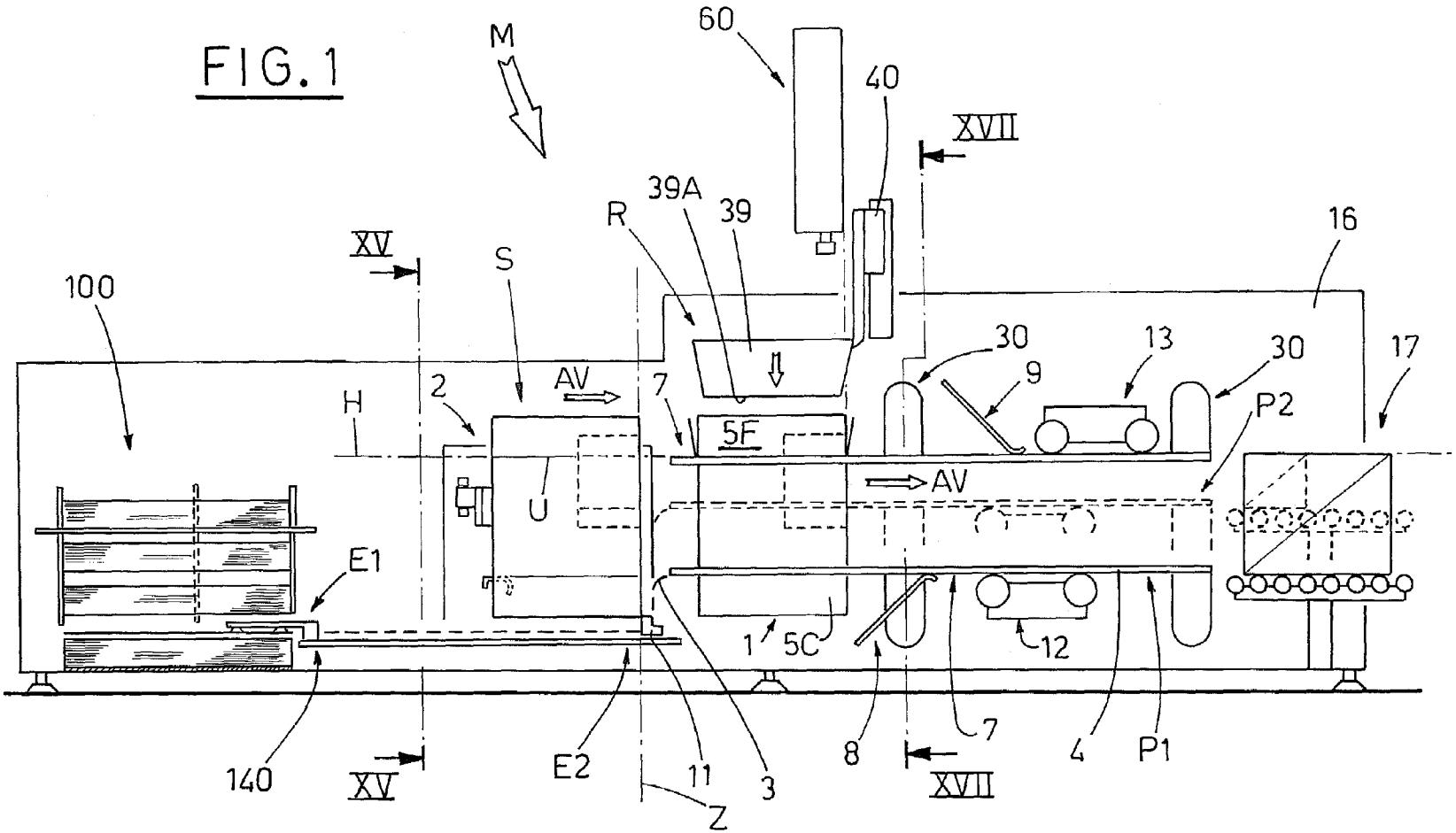
FIG. 1 is a partial and schematic, lateral view of the machine, carrying out the method proposed by the present invention, in a preferred embodiment.
Figure 2:
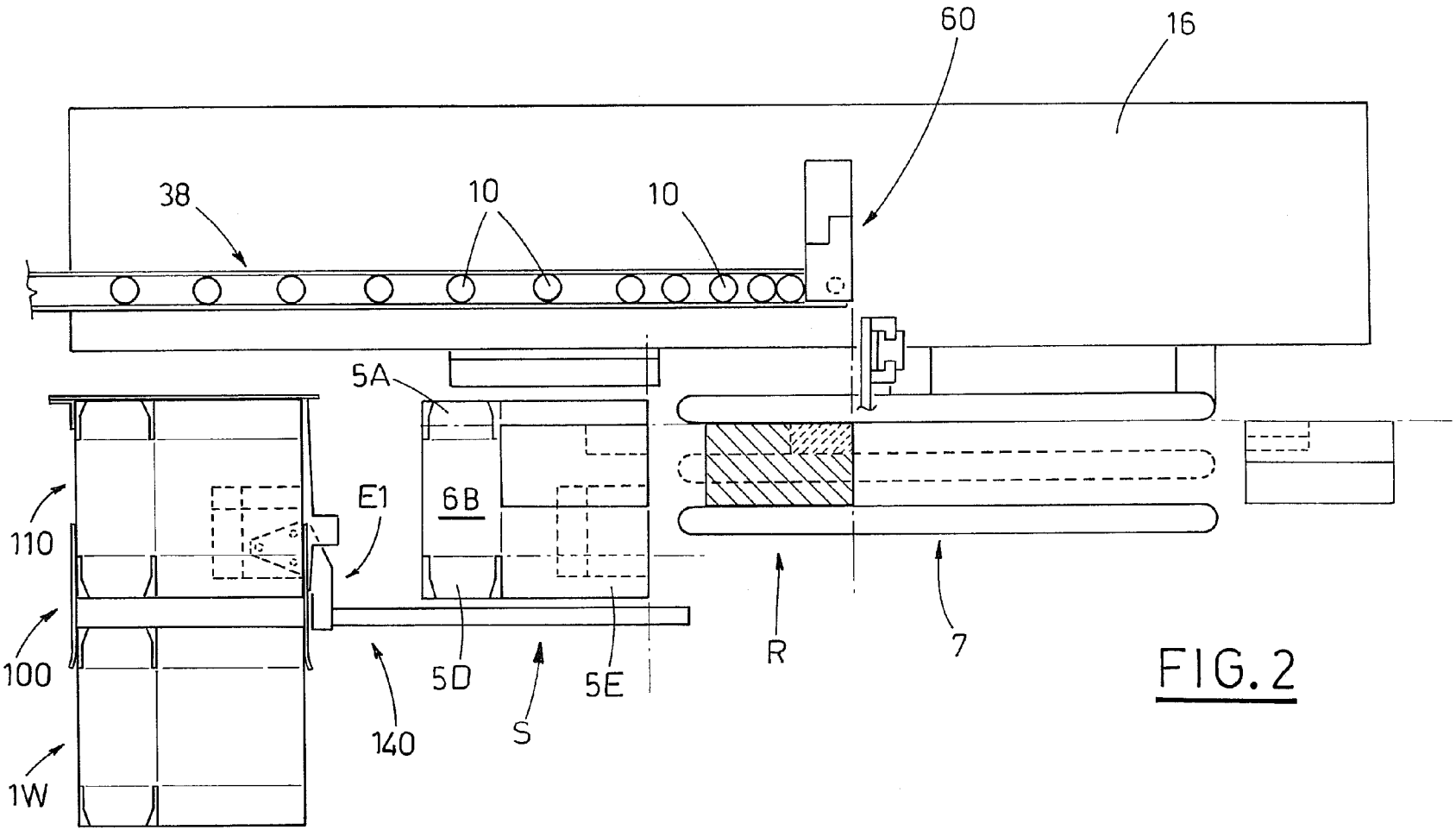
FIG. 2 is a partial and schematic, top view of the machine of FIG. 1.

Having regard to the above Figures, the reference M indicates the machine proposed by the invention as a whole.

The reference numeral 100 indicates a station for feeding, one by one, flat folded tubular blanks 1 to an erecting station 2, situated downstream of the same station 100 and aimed at erecting said blanks 1, which are then introduced in a conveying line, that takes them to further filling and closing stations.

The flat folded tubular blanks 1 are preferably made of canette cardboard and are supplied by the paper-transformation industry in packs of prefixed height, usually corresponding to 150 mm.

As it is known, an upper sheet and a lower sheet can be defined in each tubular blank 1, initially facing each other to define a flat folded configuration 1w; each blank has longitudinal and transversal pre-creasing lines, the latter being aimed at facilitating the folding of the related flaps 5A, 5B, 5C, 5D, 5E, 5F.

Figure 3:
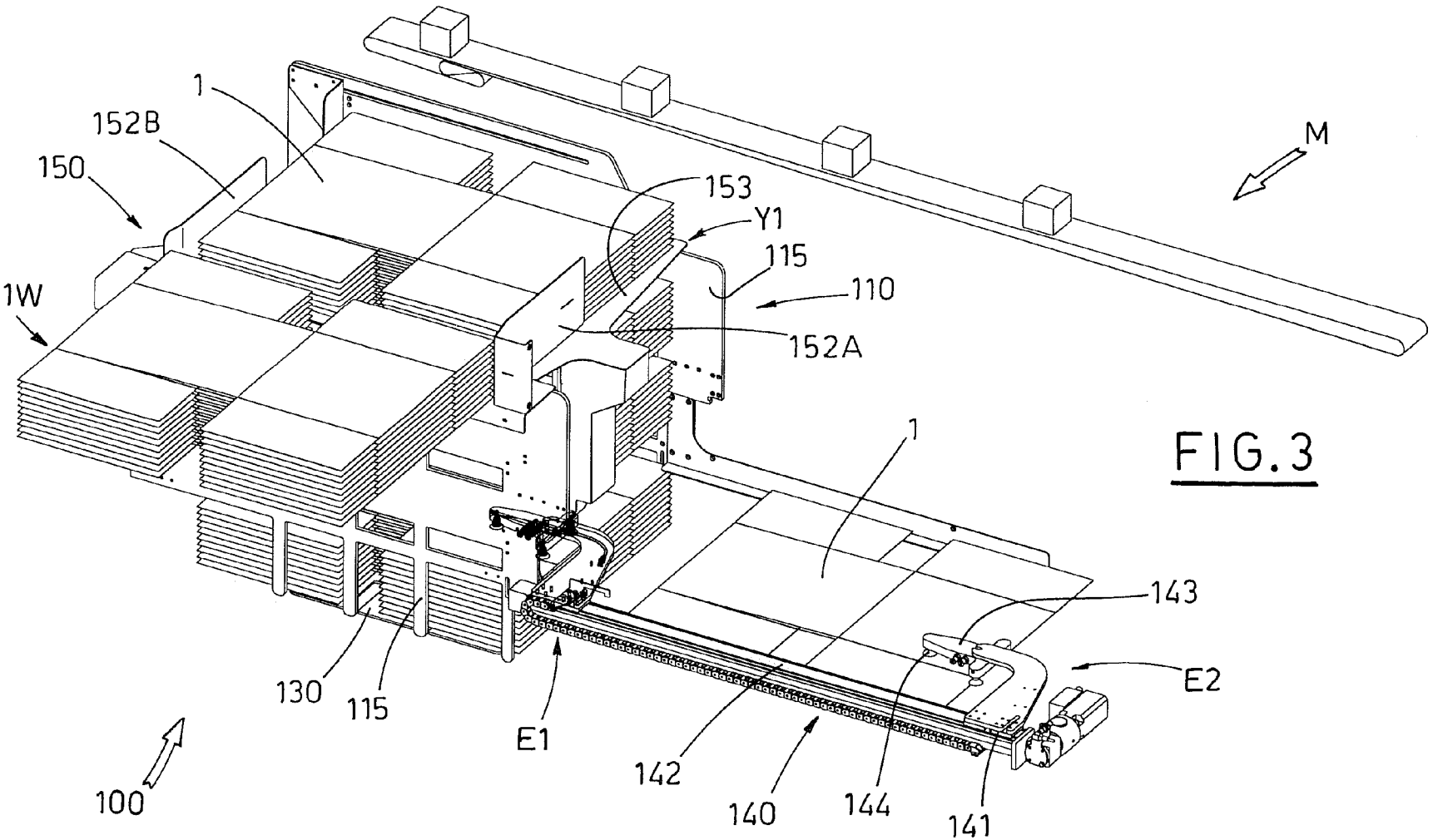
FIGS. 3 and 4 are perspective views of the station for feeding blanks of the machine, from the operator' side and the opposite one, respectively.
Figure 4:
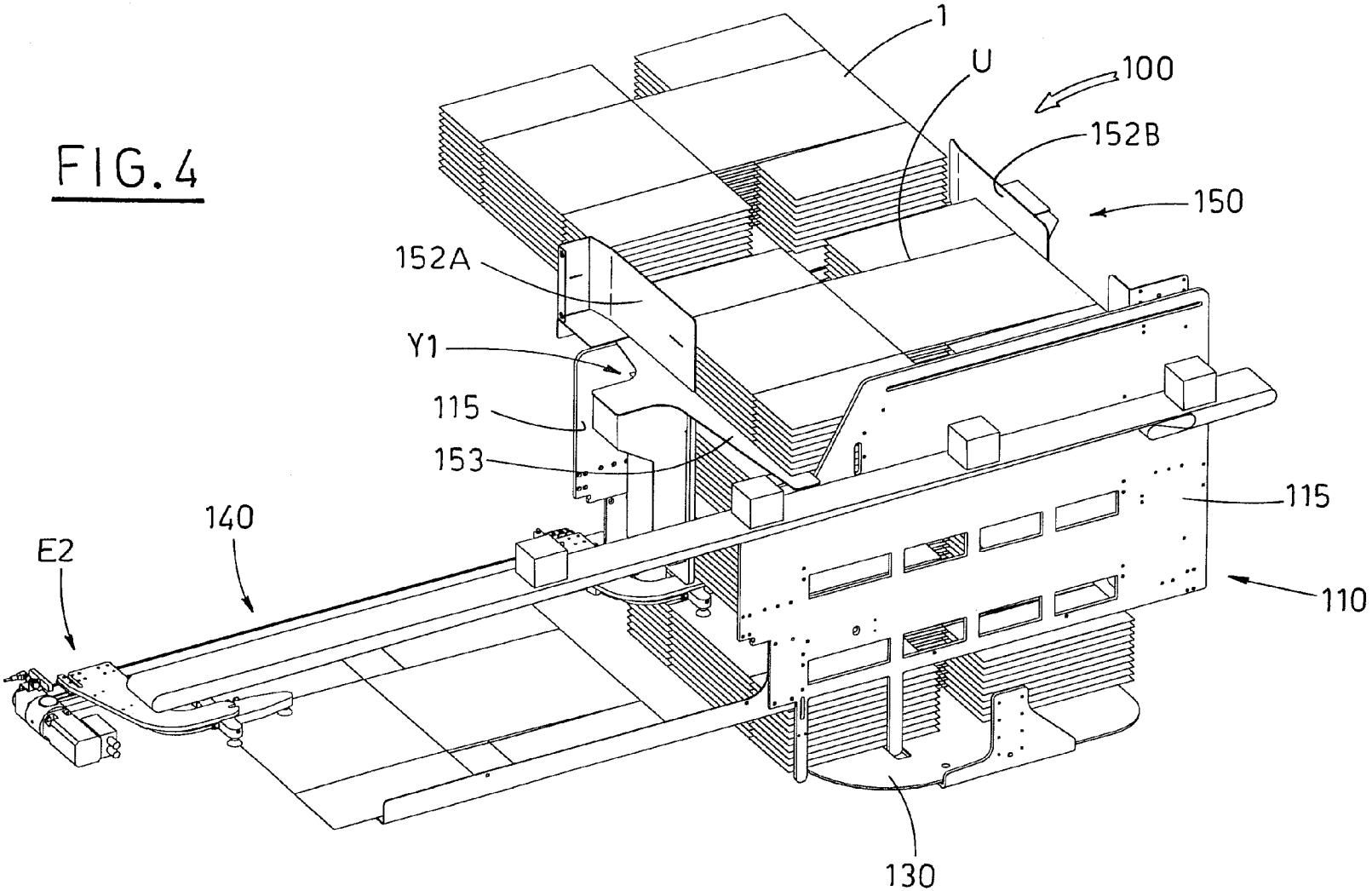

FIGS. 3, 4 show the blanks in a schematic way, without pointing out the above mentioned flaps.

The station 100 includes an in-depth storage magazine 110, aimed at containing at least a first stack P1 of blanks 1, formed by one of said packs supplied by the paper-transformation industry, suitably freed of ropes or strips, with which it was tied.

The stack P1 is introduced into the in-depth storage magazine 110, with the blanks 1 arranged horizontal and placed on first, openable support means 111, situated in a position corresponding to the lower, open mouth 100A of the magazine 100.

The in-depth storage magazine 100 is delimited peripherally by walls 115, adjustable in relation to the size, according to the plan dimensions of the blanks 1 and in alignment with fixed references of the machine M.

In the example shown in the enclosed Figures, the magazine 110 extends vertically to contain, besides the first stack P1, other two stacks P2, P3, situated at subsequent higher levels L2, L3 and supported by respective second and third openable support means 112, 113, preferably identical with the first ones.

Figure 6:
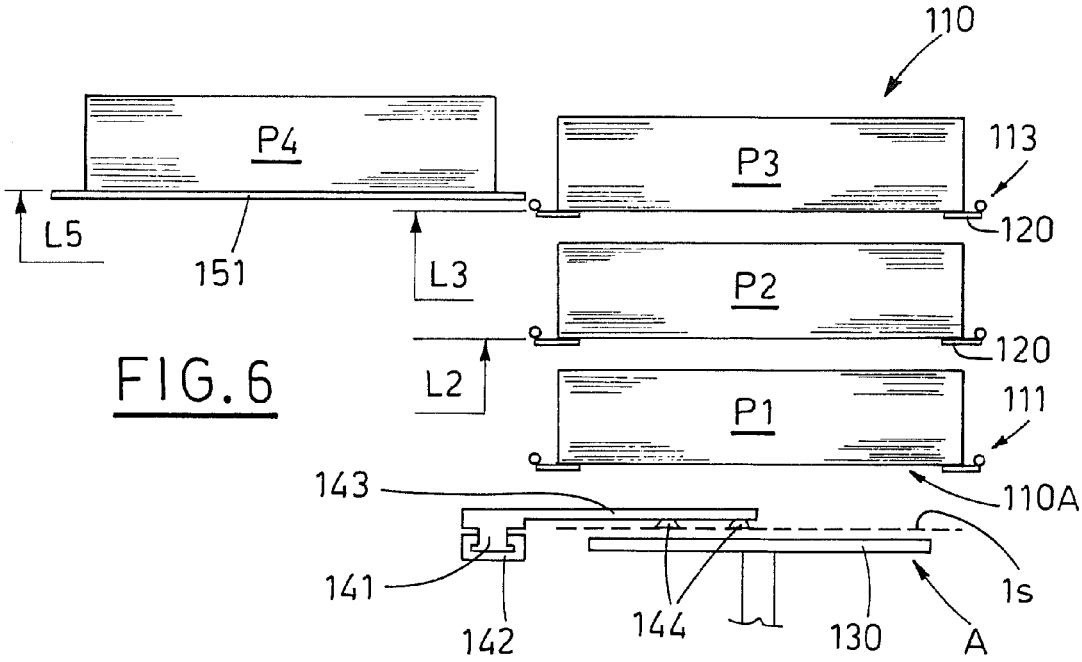
Figure 7:
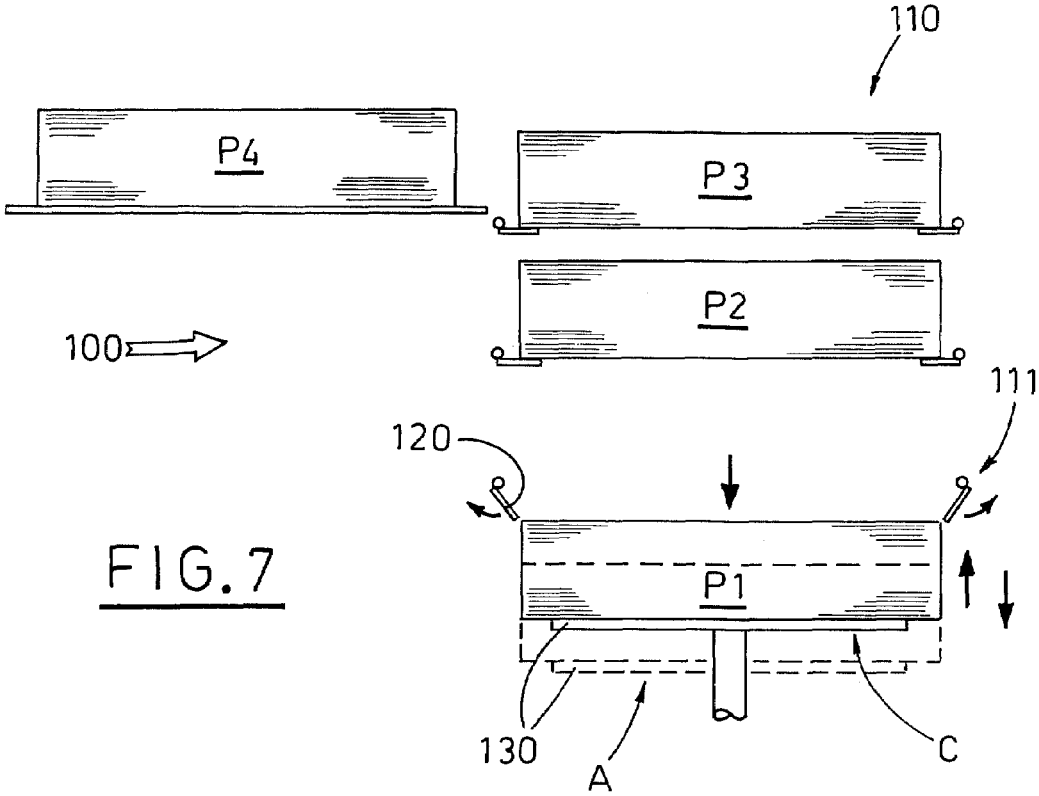
FIGS. 7, 8, 9 are the same views as FIGS. 5 and 6, of the subsequent steps of supplying of blanks to the picking up means situated in the station.
Figure 8:
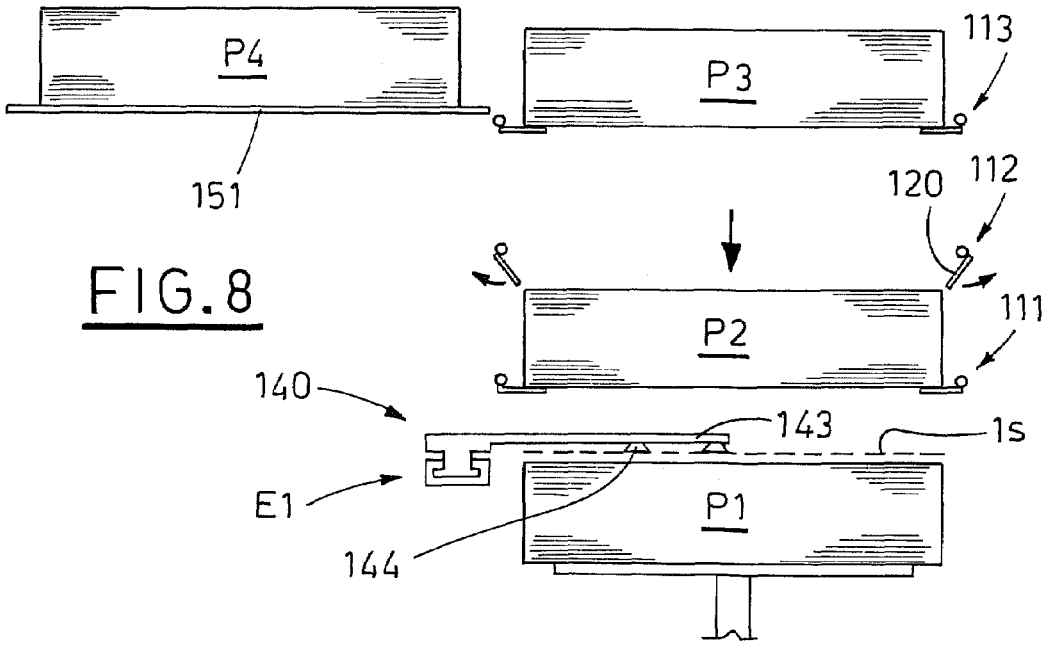

Each of said openable support means 111, 112, 113 includes, for example a pair of oscillating, opposite support paddles 120, moving synchronously between a horizontal position, in which they support corresponding edges of the bottommost blank 1 of the relative stack (FIGS. 5, 6), and a downward inclined position, in which the same blanks 1 are not held (FIGS. 7, 8).

With the described conformation of the openable support means 111, 112, 113, the stacks P1, P2, P3 contained in the magazine 100 are mutually spaced apart, so as to leave sufficient space for the movement of the respective oscillating support paddles 120.

Below the in-depth storage magazine, there is a platform 130, made move vertically by means, not shown, for example electronically controlled, aimed at defining prefixed placing levels for the same platform.

Picking up means 140, likewise provided in the station 100, move horizontally between two extreme positions E1, E2, in the first of which they are situated above the platform 130, while in the second one they are situated clear of it, in a position corresponding to the erecting station 2.

The above mentioned picking up means 140 include for example, a slide 141, engaged in a guide 142 extending horizontally between said stations 100 and 2, provided with a shaped arm 143, cantilevered toward said platform 130 area and provided with suction cups 144, connected to a vacuum source.

In the embodiment in question, conveying means 150 are advantageously connected to the in-depth storage magazine 110, situated above it and aimed at feeding the stacks of blanks 1 into the same magazine 110 and at arranging them resting on the openable support means, situated at a higher level (relatively to the Figures, the one indicated with L3 and corresponding to the support means 113).

The conveying means 150 (FIGS. 3, 4, 10, 14) include, for example a support plate 151, external with respect to the magazine 110, situated at a level L5, suitably higher than the level L3 of the cited openable support means 113 (FIG. 12), and aimed at holding at least one of said stacks of blanks 1, placed in position, for example, manually by an operator.

The support plate 151 is provided with centering walls 152A, 152B, which extend up to enter partially into the magazine 110 and are suitably adjustable in relation to the size, according to the dimensions of the blanks 1 and in alignment with said fixed references.

At least one retractable blade 153, aligned with the support plate 151, at a level L4, slightly lower than level L5 of the bearing pad (FIG. 12), is provided in a position corresponding to an edge of said blanks 1, to continue the support plate 151.

The retractable blade 153 is moved, by the action of an actuator, not shown, between a working position Y1, in which it is aimed at supporting, above the magazine 110, a stack of blanks 1, coming from the support plate 151, due to manual action of said operator (FIG. 10), and a rest position Y2, in which it is clear of the surface occupied by the same blanks 1, to allow them to enter the magazine 110, (FIG. 14), as it will be better described in the following.

In the shown conveying means 150, the support plate 151 and the retractable blade 153 extend perpendicular to the movement direction of the conveying line 103 of the machine M and of the slide 141; the support plate 151 extends at the machine side occupied by the operator, but obviously, such arrangement is not binding, because it can also be parallel to the above mentioned direction; naturally, in this case it would also be necessary to change the arrangement of the retractable blade 153.

FIG. 11 shows a constructive peculiarity of the support plate 151, which is inclined by some degrees with respect to the horizontal, so that the stack of blanks 1, resting thereon, remains in a position set by a fixed reference F (defined by the inner surface of the adjacent centering wall 152A), situated on the side with the retractable blade 153; this inclination facilitates also the stack transferring toward the retractable blade 153, keeping raised the opposite side, so as to prevent the stack bottommost blanks from getting stuck against the support paddles due to their slight downward bending (FIG. 12).

The movement of said openable support means 111, 112, 113 of the platform 130 and of the picking up means 140, as well as the vacuum activation for the suction cups 44, are managed by the unit (not shown), which controls the machine M, so as to ensure suitable step relations.

Now, the operation of the above described station 100 will be described, beginning from the situation shown in FIG. 5, in which:

the in-depth storage magazine 110 is full, with the stacks P1, P2, P3 resting on the support means 111, 112, 113, respectively;

a stock stack P4 is placed on the support plate 151 of the conveying means 150;

the platform 130 is situated at a prefixed height corresponding to a waiting position A and supports a still entire stack P of blanks 1, whose feeding way by the magazine 10 will be described later;

the slide 141, with the associated shaped arm 143, are in their position E1, above the platform 130.

Figure 5:
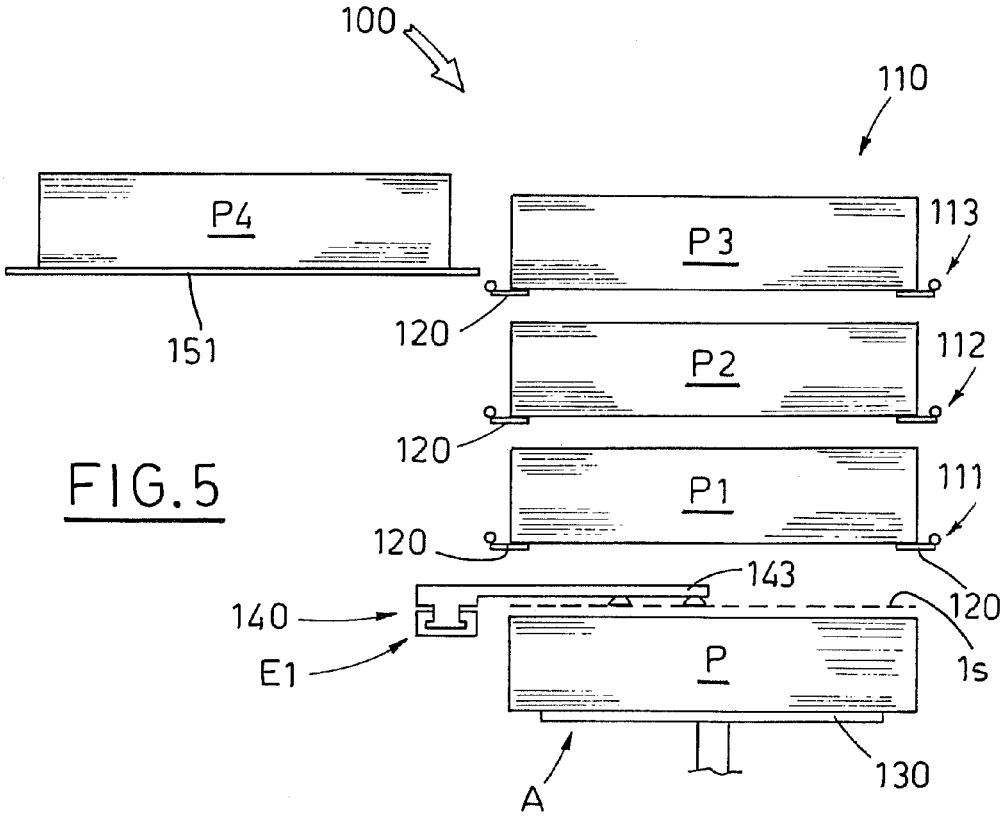
FIGS. 5 and 6 are schematic views, in vertical section, of the feeding station in two work steps, while picking up the blanks.

In step relation with the vacuum activation in the suction cups 144, the platform 130 performs a calibrated rise, that brings the topmost blank 1S of said stack P, to such a level, indicated with broken line in the same FIG. 5, as to be picked up by the suction cups 144.

After the topmost blank 1S has been picked up by the suction cups 144, the platform 130 goes down again to a waiting position A, higher than the previous one by a distance equal to the thickness of a blank; afterwards, the slide 141 is operated to perform its forward stroke toward the position E2, until it goes in abutment against a stationary stop 11, situated in the erecting station S.

Once the blank has been delivered, the slide 141 performs the backward stroke and returns to the previous position E2, to pick up the second blank 1 from the stack P, i.e. the right now become topmost blank 1S.

The platform 130 performs another calibrated rise, to bring the new topmost blank 1S to the same level as the first one, and to place it at a level such that it touches the suction cups 144; said rise is followed by a descent of the same platform 130 to a new waiting position A, further higher by a distance equal to the thickness of a blank.

The above mentioned operations follow one another cyclically to pick up all the blanks of the stack, with a descent of the platform 130 to waiting positions A each time higher.

The picking up of the last blank 1 from the stack P is shown in FIG. 6, with the platform 30 in its waiting position A.

Otherwise, the platform 130 rise and descent steps, in which the waiting position A is raised by one distance with each cycle, can be realized by a fixed waiting position A, with rises and descents increased each time by a distance equal to the thickness of a blank 1.

When the slide 141, with the last blank of the stack P, has left the space occupied by the platform 130, the latter is raised to a loading position C, so as to receive the first stack P1, contained in the magazine 110, released by the first openable support means 111 (FIG. 7); then, the platform is lowered again to the waiting position A, related to the whole stack (broken lines in the same FIG. 7), so as to allow the slide to return to its position E2.

While the slide 141, with the suction cups 144, begins again its picking up task of the topmost blank 1*s*, in cooperation with the platform 130 rise and descent, the second support means 112, in the meanwhile closed again, are operated to open, so as to allow the second stack P2 to go down to occupy a lower position, resting on the first support means 111 (FIG. 8).

Figure 9:
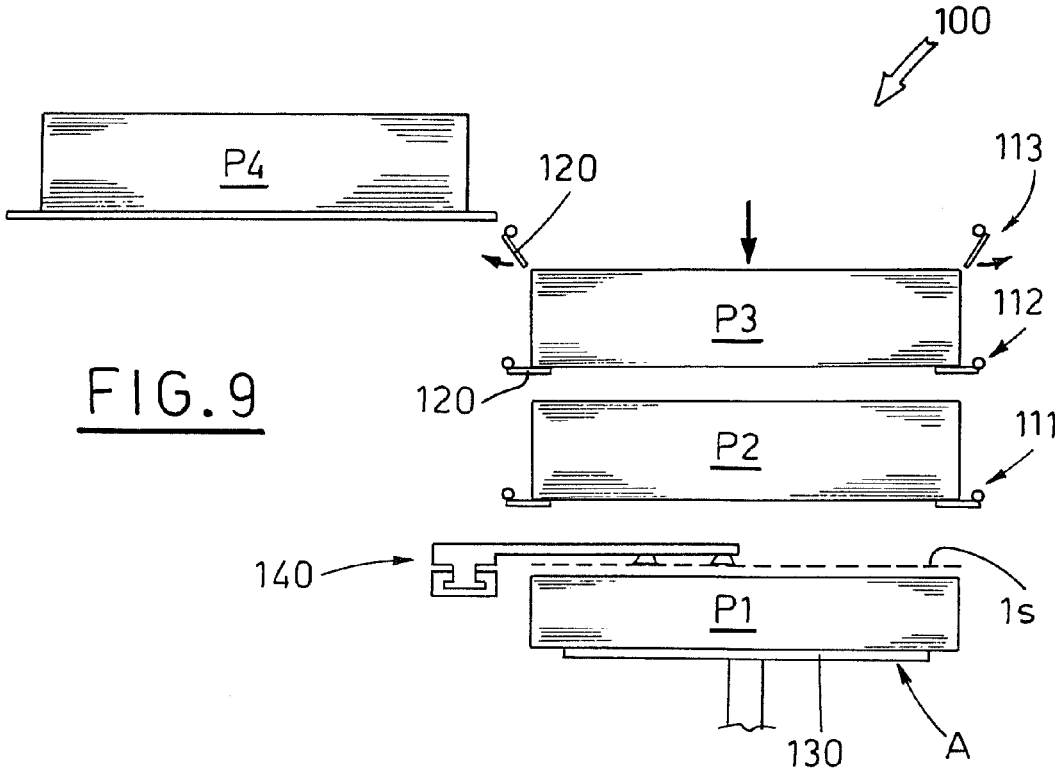

Next, the third support means 113 are operated to open, so as to allow the third stack P3 to go down and rest on the second support means 112 below, in the meanwhile closed again (FIG. 9).

When this step is completed, after the re-closing of the support means 113, the operator can move manually the stock stack P4 to transfer it from the support plate 151 (FIGS. 10, 11) to the retractable blade 153, arranged in its work position Y1 (FIG. 12).

At this point, the blade 153 is operated to move to a rest position Y2, making the pile P4 fall into the magazine 110, to rest on the third support means 113, in the meanwhile closed again (FIGS. 13, 14); the command to move the blade 153 can be given directly by the operator or automatically by the machine M control unit, enabled by suitable sensor means, not shown.

Figure 13:
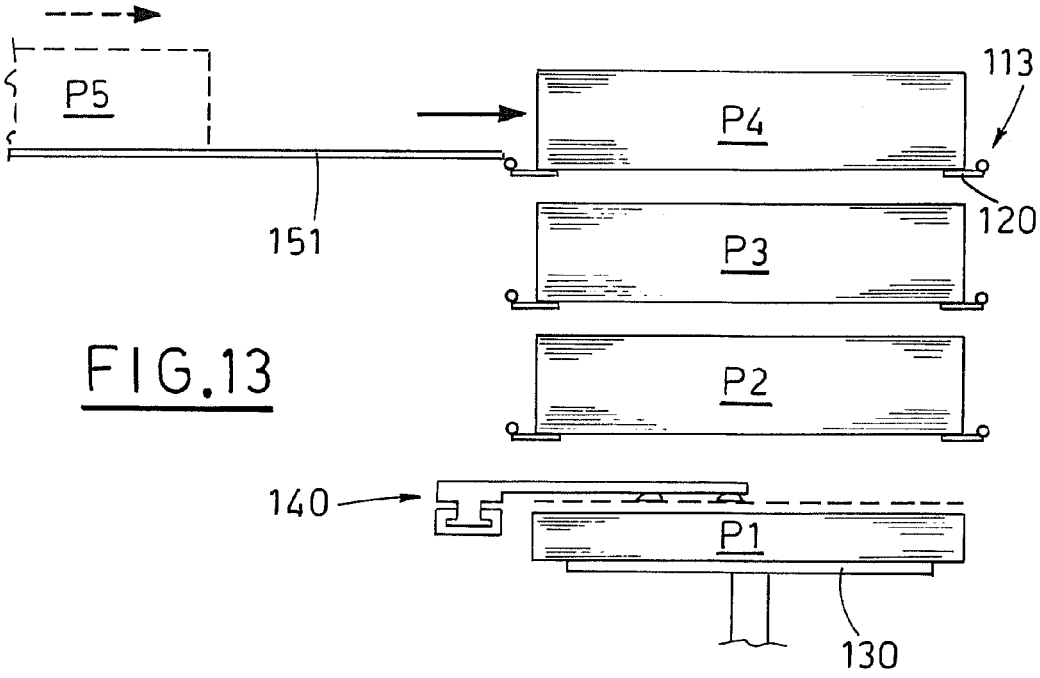
FIG. 13 is the same view as FIGS. 5, 6, 7, 8, 9, of the magazine loading step.
Figure 15A:
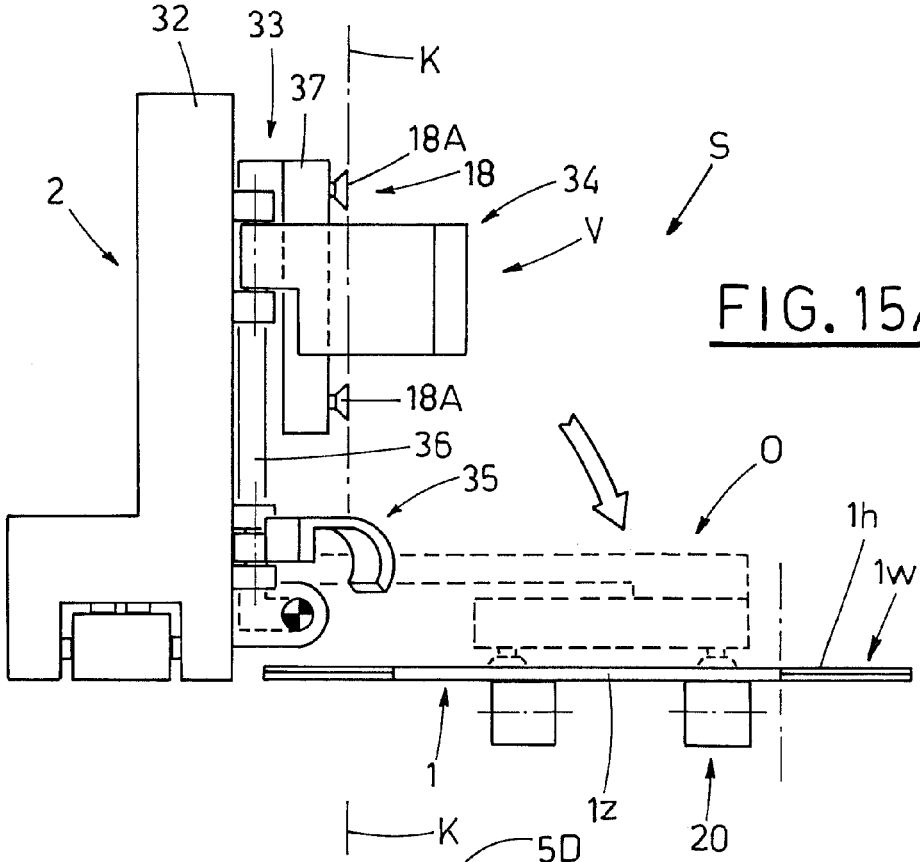
FIGS. 15A-15B are enlarged, front views XV-XV of FIG. 1, that is a unit for erecting a tubular blank, in this case of maximum size, in two different, significant operation conditions.
Figure 15B:
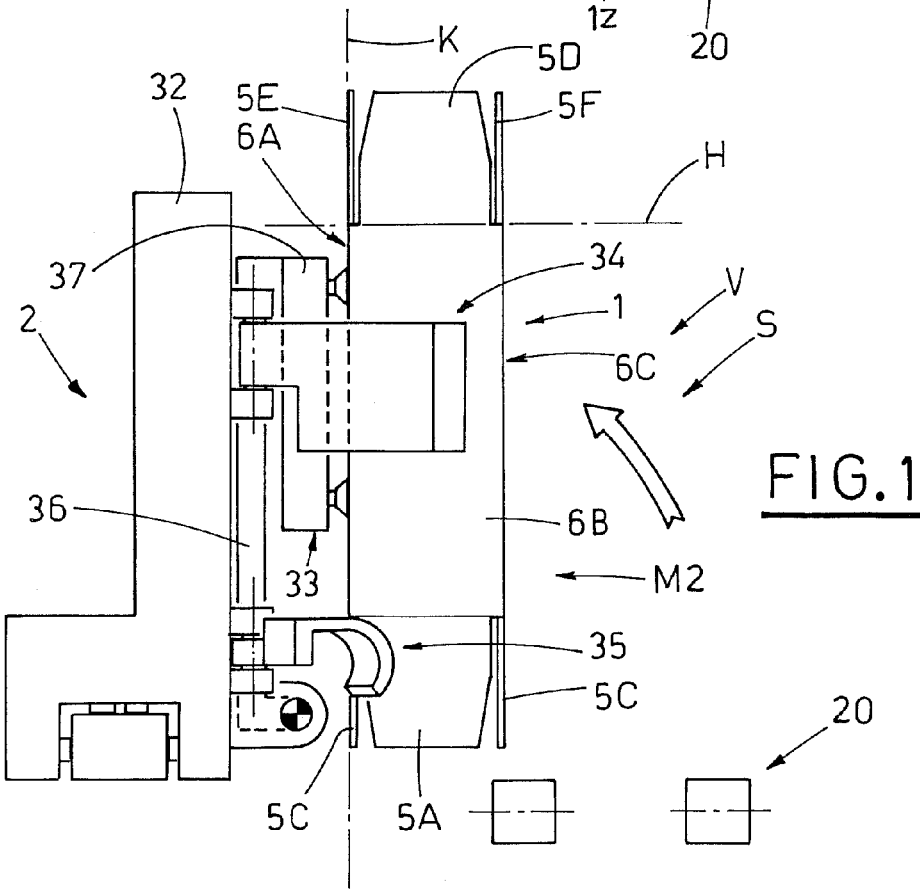
Figure 15C:
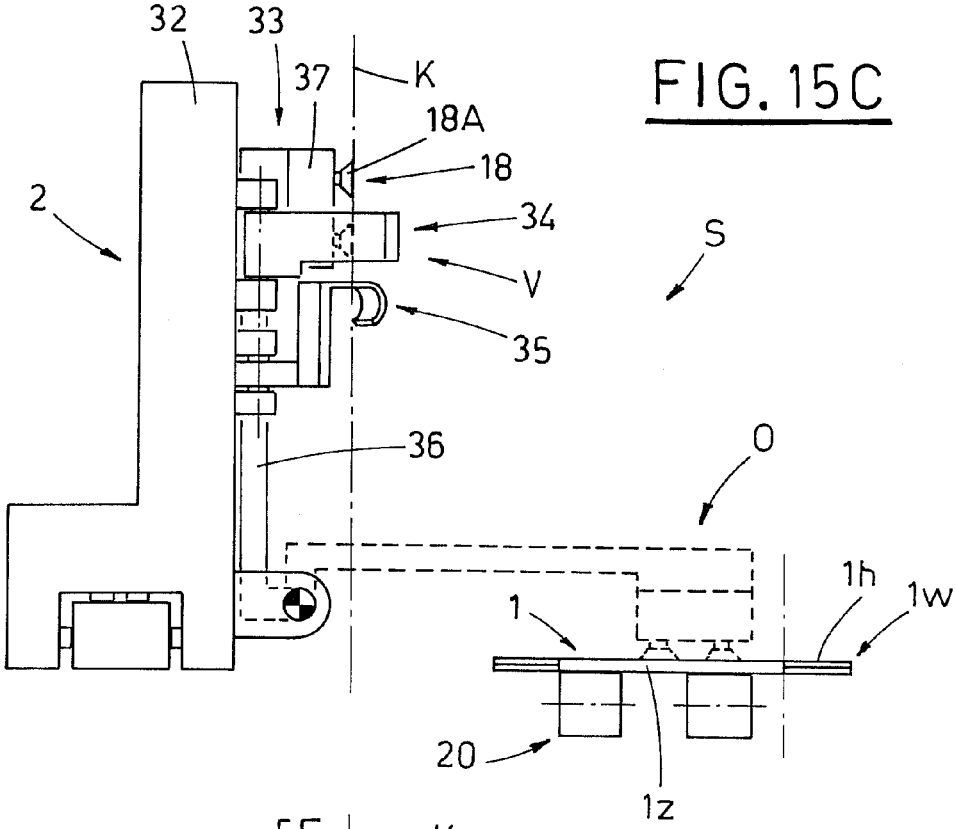
FIGS. 15C-15D show the unit of FIGS. 15A, 15B in two different, significant operation conditions, in relation to a tubular blank with minimum size.
Figure 15D:
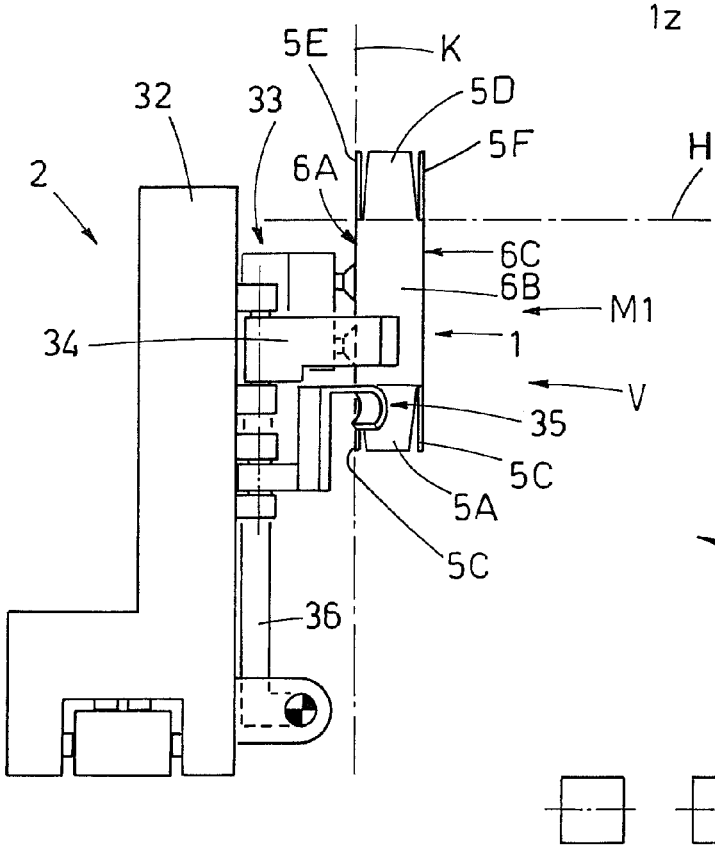
Figure 16A:
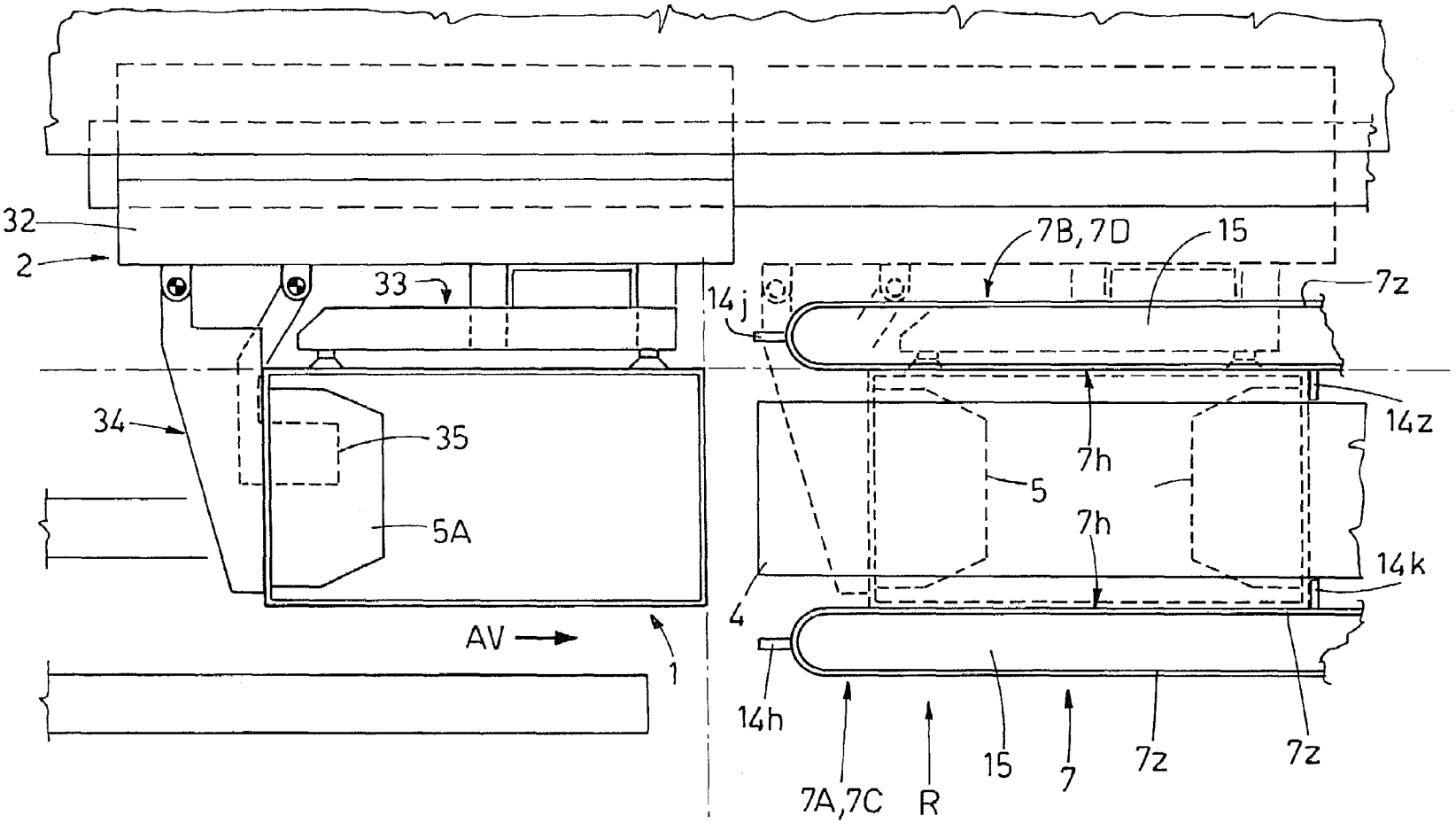
FIGS. 16A, 16B are enlarged, partial, top views of a detail of FIG. 1, that is the above mentioned erecting unit, acting on a blank with maximum and minimum size, respectively, and driving and guiding means.
Figure 16B:
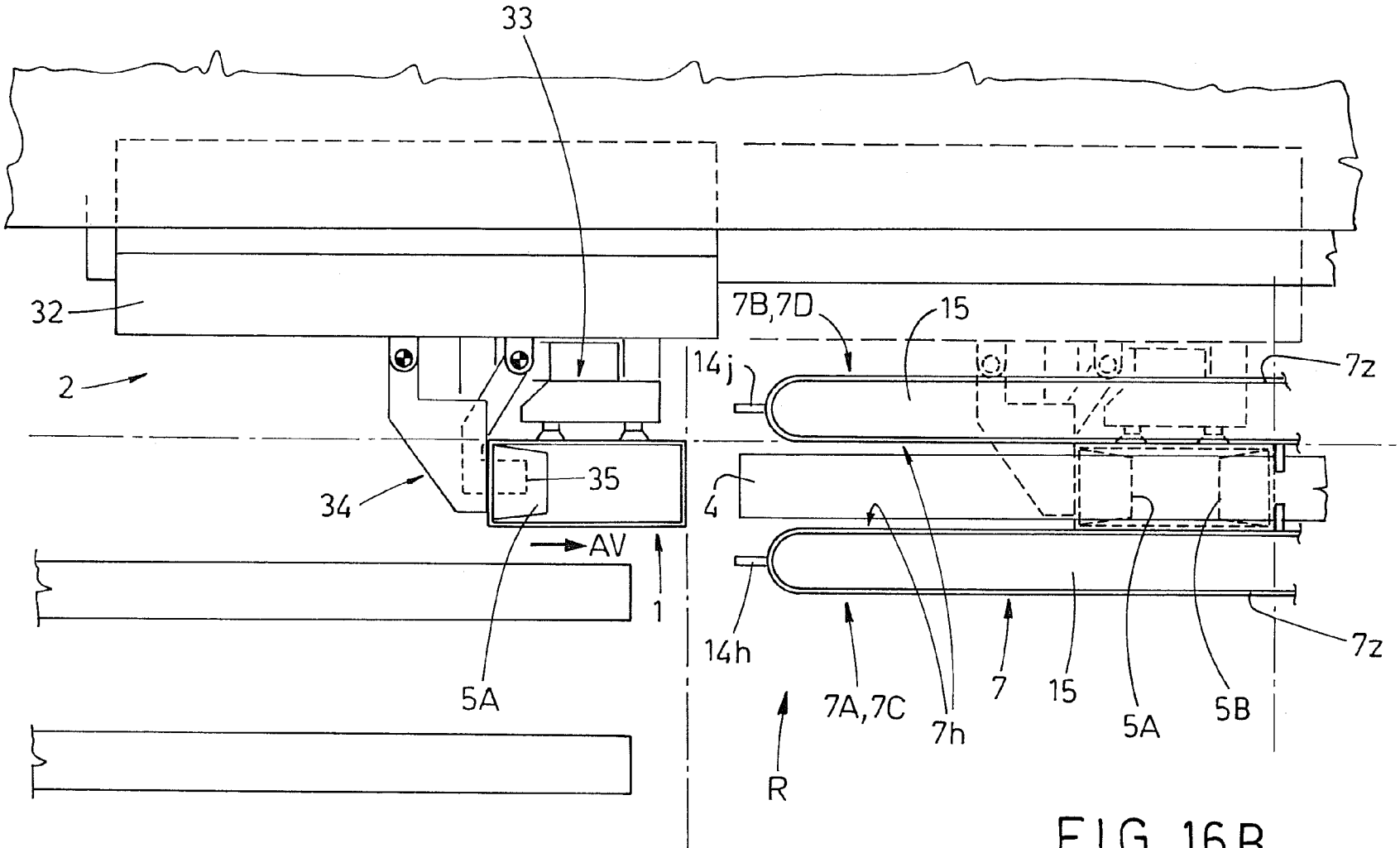

Later, the operator loads a new pile P5 onto the support plate 151 (indicated with broken lines in the same FIGS. 13 and 14).

A unit 2, moving between the erecting station S and a filling station R, erects the tubular blanks 1 in flat folded configuration 1*w* and folds their lower flaps 5A, located at the back with respect to a prefixed direction AV in which the blanks 1 are moved in the proposed boxing machine. The unit 2 includes a carriage 32, moved by first actuator means (not shown) between the just mentioned stations S, R, and carrying first folding means 34 and second folding means 35, and a gripping group 33 for gripping a first lateral wall 6A of the blank 1 and raising the blank 1 while rotating it, so that it assumes parallelepiped form and vertical axis.

The gripping and raising unit 33 includes an arm 36 hinged to the carriage 32, along a horizontal hinge line perpendicular to the direction defined by the longitudinal pre-creasing lines of the tubular blanks 1 arriving at the erecting station S. The arm 36 supports a pad 37, which carries gripping means 18 designed to grip the first lateral wall 6A of the blanks 1, e.g. a plurality of suction cups 18A, connected to a vacuum source, not shown. Second actuator means, likewise not shown as known, are aimed at operating the arm 36 between a horizontal position O and a vertical one V (see FIGS. 15A-15D), rotating by ninety degrees during the passage from one configuration to another. In particular, in the last configuration, the active surface of the suction cups 18A defines a second vertical stationary plane K, perpendicular to the first one Z, discussed later in the treatment.

From now on, the first folding means 34 and second folding means 35 will be referred to only in relation to their specific function; for other details regarding the unit 2 under consideration, see the EP Application No. 06121376.5.

Manipulating means 60 of known type, working in the space between a line 38 feeding articles 10 and the filling station R, are aimed at introducing, in vertical direction, articles 10 into the blanks 1, erected and with the axis oriented vertical, stationary in the station R, as it will be better explained later. A hopper 39 is situated in the filling station R, above the blanks 1 passing through this station, and is moved vertically by third actuator means 40, in step relation with the movement of the manipulating means 60 and of the tubular blanks 1.

A fixed folding member 3, shown schematically in FIG. 1, is situated near the filling station R and is aimed at intercepting and folding, by a ninety degree angle, the second lower flap 5B of each blank 1 reaching the filling station R. In particular, the second flap 5B faces the first lower flap 5A, because it is situated at the front with respect to the forwarding direction AV.

A horizontal plane 4 extends in length from the filling station R up to a first station 12, (described later), for closing the bottom of the blanks 1. The horizontal plane overhangs the first station 12. The horizontal plane is aimed at supporting the erected tubular blanks 1, which are moved in a forwarding direction AV and its height can be adjusted choosing among a plurality of possible positions, including a lowered position B1, associated to a maximum size M2 of the blanks (FIGS. 1, 17A), and a raised position B2, associated to a minimum size M1 (FIGS. 1, 17B). The support plane 4 is located in accordance with the blank 1 size, at such a level that the upper transversal pre-creasing lines U are always aligned with a third fixed, horizontal reference plane H (FIG. 1, 17A, 17B for example). Likewise, the width of the support plane 4 depends directly on the size of the blank 1 being used.

Guide means 7 are aimed at guiding the erected tubular blanks 1 and at moving them along the horizontal support plane 4, in the same direction as the forwarding direction AV, from the filling station R up to means aimed at folding lower lateral flaps 5C, upper flaps, fore 5D and rear 5D, and lateral flaps 5E, 5F of each blank 1, as well as to stations 12, 13, aimed at closing the bottom and the cover of the so defined box-like pack, as it will be described later. The means 7 include four endless conveyors, upper 7A, 7B and lower 7C, 7D, operated respectively by separate actuator means (not shown for sake of simplicity), and, for example, two work groups 30 for supporting and positioning, in a relevant space, the conveyors 7A, 7B, 7C, 7D, according to the blanks 1 size (see FIGS. 17A, 17B as an indication).

In the shown example, each of the conveyors 7A, 7B, 7C, 7D includes an endless chain 7*z*, having its active run 7*h* oriented longitudinal with respect to the machine (that is, in the same direction as the forwarding direction AV), turning around a corresponding chain mounting element 15, supported by the work groups 30 and cantilevered in the filling station R. The chain mounting element 15 has a predetermined profile and conformation, such that the active run 7*h* acts as a guide for transferring the blanks 1 from the filling station R in the forwarding direction AV. The active runs 7*h* of the conveyors 7A, 7B, 7C, 7D face the respective lower and upper longitudinal portions of each of the opposite walls, first 6A and third 6C, of the erected tubular blanks 1, without interfering with the gripping means 18 of the first lateral wall 6A. The lower conveyors 7C, 7D and the upper conveyors 7A, 7B, have, associated thereto, at least a pair of respective first 14*h*, 14*j* and second 14*k*, 14*z*, lateral protrusions (FIGS. 16A, 16B, 17A, 17B), fastened to the relative chains 7*z* and aimed, in the order, at going in abutment against corresponding portions of the back wall 6B and front wall 6D of the blank 1 with respect to the forward movement direction AV. Each pair of the first 14*h*, 14*j* and second 14*k*, 14*z* lateral protrusions are clearly aligned in pairs with along separate vertical planes (just because they are aimed at abutting against and intercepting the tubular blanks 1 being erected), so that the second 14*k*, 14*z* are in advance with respect to the first ones 14*h*, 14*j*, in the forwarding direction AV, by a distance equal to the longitudinal dimension of the blanks 1.

Figure 17A:
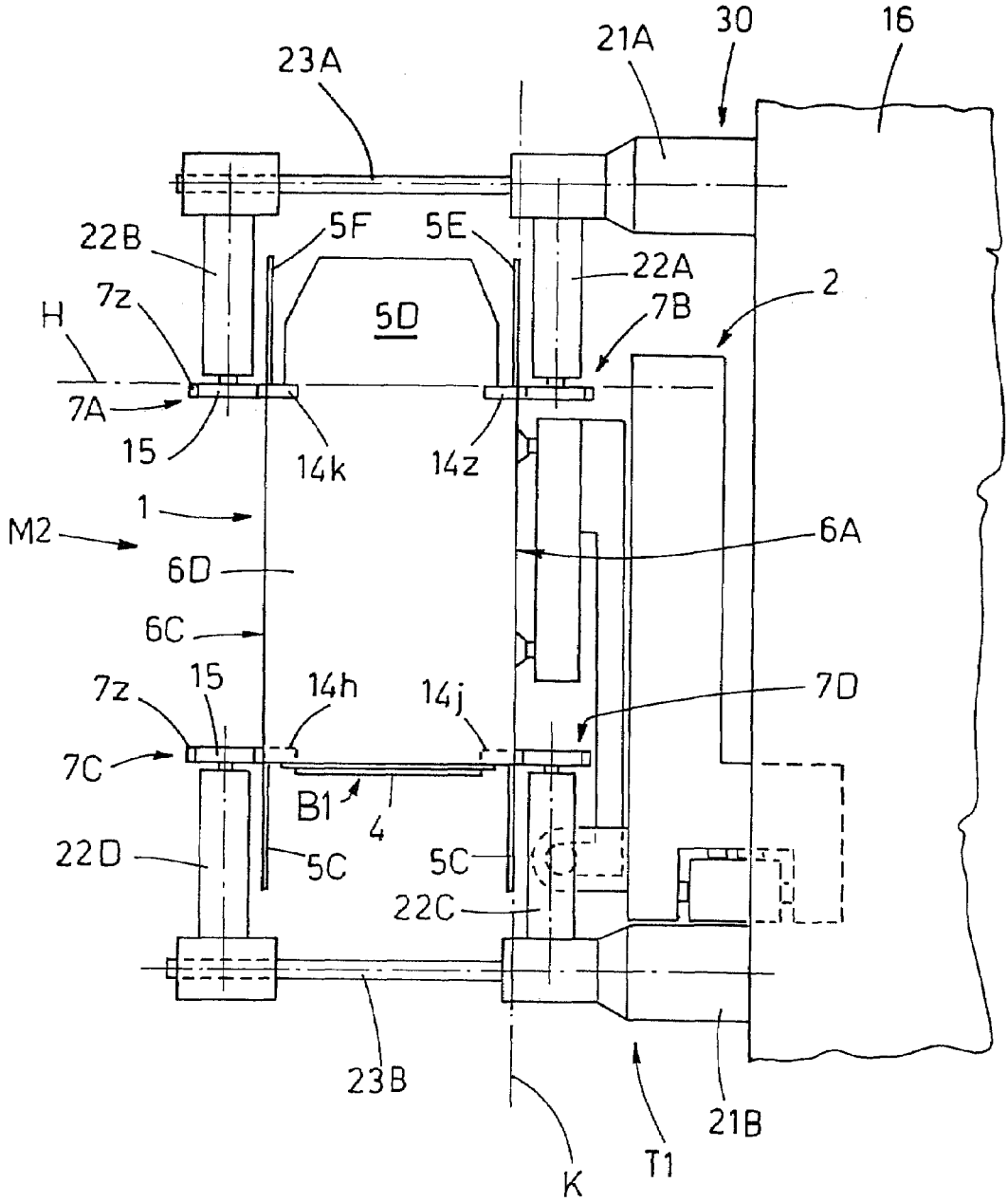
FIGS. 17A, 17B are section views, taken along the plane XVII-XVII of FIG. 1, of an erected blank with maximum and minimum size, respectively.
Figure 17B:
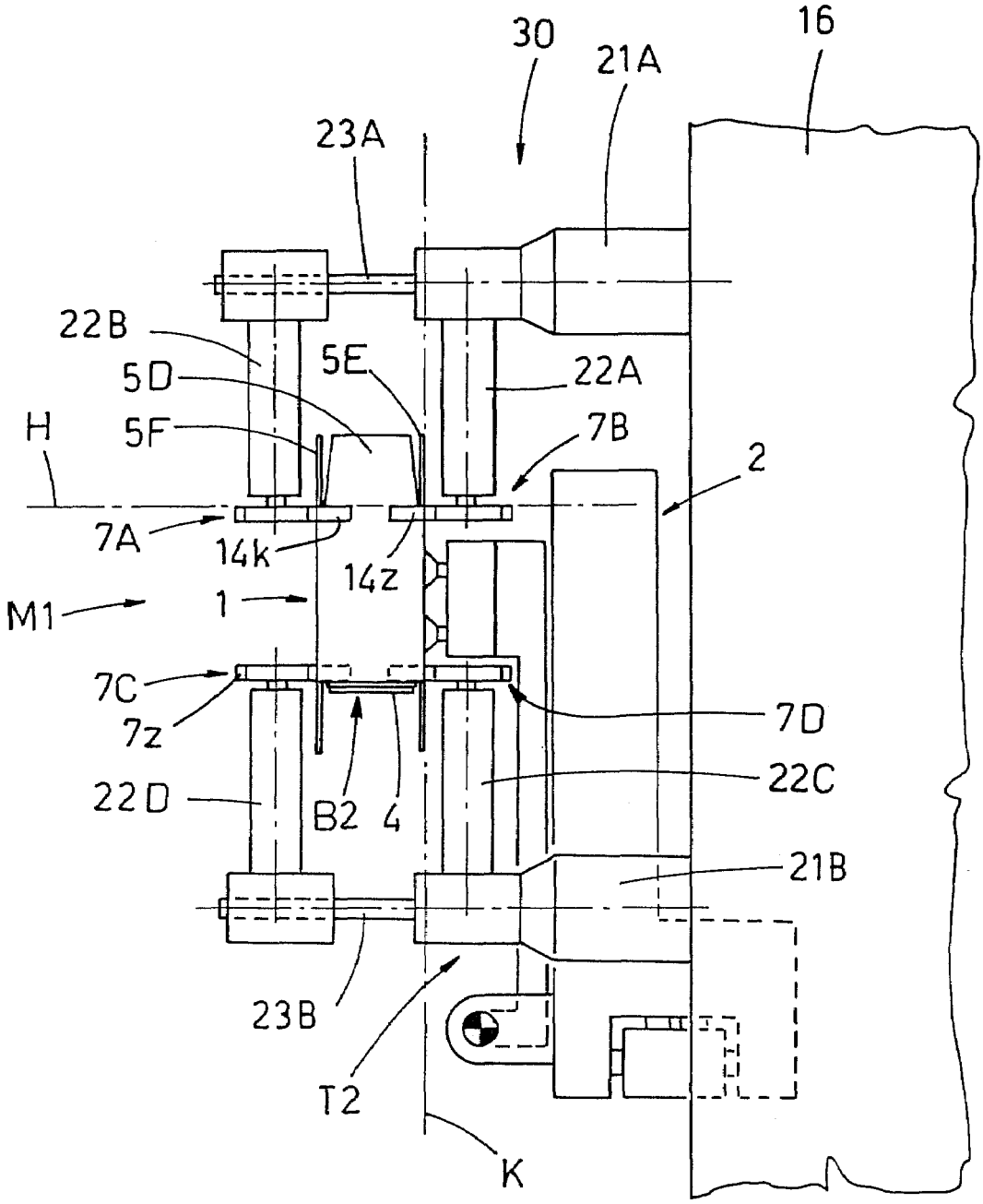

FIGS. 17A, 17B are cross-sectional views taken along XVII-XVII of FIG. 1, of a work group 30, described later. The other work group 30, shown schematically in FIG. 1, is wholly similar to the one just mentioned, except for the presence of the actuator means, which, for example, drive to rotate corresponding toothed wheels having vertical axis, each of which engages with the relative winding ends of the chains 7*z* of the conveyors 7A, 7B, 7C, 7D, so that the lower conveyors 7C, 7D are powered in any case independently from the upper conveyors 7A, 7B.

The work group 30 under consideration is an integral part of the frame 16 of the boxing machine and includes a stationary upper turret 21A, which carries a first vertical arm 22A supporting the chain mounting element 15, associated to the upper conveyor 7B. A first transversal stem 23A is removably joined, with respect to translation motion, with the turret 21A and carries a second vertical arm 22B, supporting the chain mounting element 15, associated to the upper conveyor 7A, in outer position with respect to the just mentioned conveyor 7B (see again FIGS. 17A, 17B). The position of the first transversal stem 23A is adjusted in relation to the size of the blank 1 being used, so that the second pairs of protrusions 14*k*, 14*z* can abut against corresponding portions of the front wall 6D of the erected blanks 1. The group 30 includes also a lower turret 21B, which can be adjusted to take one of a plurality of positions included between a lowered position T1, associated to the maximum size M2 of the erected blank 1, and a raised position T2, associated to the minimum size M1. The lower turret 21B carries also a third vertical arm 22C, supporting the chain mounting element 15, associated to the lower conveyor 7D, and engages with a second transversal arm 23B, removably joined with respect to translation motion, and carrying in turn a fourth vertical arm 22D, supporting the chain mounting element 15, with associated thereto the lower conveyor 7C, in outer position with respect to the just mentioned lower conveyor 7D. Still with reference to FIGS. 17A, 17B, it is specified that the first vertical arm 22A and the second vertical arm 22B extend downwards, whereas the third vertical arm 22C and the fourth vertical arm 22D extend upwards. As it can be seen in Figures, the horizontal support plane 4 is interposed between the third vertical arm 22C and the fourth vertical arm 22D. Also the position assumed by the lower turret 21B and the second transversal arm 23B depends on the size of the blank 1, because it is necessary to ensure interception of corresponding portions of the surface of the blanks 1 back wall 6B, by the first protrusions 14*h*, 14*j*. For example, the lower turret 21B is always integral with the movement of the horizontal support plane 4, when the size of the blanks 1 in use is changed.

Folding means, not shown as known, are situated downstream of the filling station R with respect to the forwarding direction AV and fold the upper flaps, fore 5D and rear 5D, of each already erected blank 1.

First means 8, aimed at folding the lower lateral flaps 5C of the blanks 1, are situated downstream of the filling station R with reference to the forwarding direction AV (FIG. 1). They are connected to the horizontal support plane 4 and include first rods, having a predetermined space orientation. Likewise, second means 9 for folding upper lateral flaps 5E, 5F of the blanks 1 are situated downstream of the filling station R and of the above mentioned folding means, with reference to the forwarding direction AV. The second folding means 9 include second rods 9*h*, 9*k*, integral with the machine frame 16 and having a given space orientation (see corresponding orthogonal projections shown in FIGS. 18A, 19A and 18B, 19B, for the maximum size M2 and for the minimum size M1 of each blank 1, respectively).

A first station 12 is situated downstream of the first folding means 8 and is aimed at closing firmly the bottom of the erected tubular blank 1, formed by the first lower flap 5A and second lower flap 5B (the rear flap 5A and the fore flap 5B, respectively, with reference to the forwarding direction AV), folded inwards by a ninety degree angle, and immediately below, by the lower lateral flaps 5C, likewise folded inwards by a ninety degree angle. A second station 13 is likewise situated downstream of the second folding means 9 and is aimed at closing firmly the cover of the so obtained box-like container, defined in turn by the upper flap, rear 5D and fore 5D, folded inwards by a ninety degree angle and immediately above, by the upper lateral flaps 5E, 5F of the blank 1, likewise folded inwards by a right angle. The first station 12 and the second station 13 include means of known type for closing firmly the bottom and the cover, respectively, of the box-like container: for example, with reference to the first station 12, some portions of the lower flaps 5A, 5B, 5C of the blank 1 can be mutually glued or at least terminal, and opposite, portions of the lower lateral flaps 5C of the blank 1 can be closed by adhesive tape. The same considerations are valid also for the second station 13.

Finally, a support element 17, e.g. roller track, is situated downstream of the first station 12 and the second station 13, with reference to the forwarding direction AV, for receiving the boxes pulled by the conveyors 7A, 7B, 7C, 7D (FIG. 1).

It is specified that the folding element 3, the first folding means 8, the first closing station 12 and the roller track 17 are fixed with respect to the horizontal support plane 4, therefore, they move together with the latter during the adjustments, which are necessary to change the size of the blanks 1 in use.

The proposed boxing machine performs systematically repetitive operations on the box-like containers being formed: in the following, the reference will be made to only one of these working cycles, supposing first only one erected blank 1 sliding on the horizontal support plane 4, then more than one.

The suction cups 144 of the arm 143, carried by the slide 141, pick up the tubular blanks in flat folded configuration 1*w* from the magazine 110, one by one; with the slide 141 in said outer position E2, the blank goes in abutment against the chain mounting element 11. In this position, a prefixed transversal pre-creasing line U is aligned with a vertical plane H1, independently from the blank 1 dimensions.

The arm 36 of the gripping and raising unit 33 is then taken to the horizontal position O, and the suction cups 18A get in contact with the first lateral wall 6A of the blank 1, belonging to the upper sheet 1*h*. Then the suction cups 18A are activated to suck, so as to grip the first lateral wall 6A, and to make the arm 36 return to the vertical position V. Next, the tubular blank 1 is raised (FIGS. 15B, 15D) by the gripping action of the means 18 on the first lateral wall 6A, and at the same time, it is rotated by a ninety degree angle, bringing the first lateral wall 6A from a horizontal position to a vertical one, in which it is aligned with the second fixed reference plane K. In particular, the proper weight of the blank 1 and its raising to rotation, cause its partial erecting, making it assume a parallelepiped form with vertical axis, with the relative upper pre-creasing lines U aligned with the third fixed horizontal reference plane H. The first and second folding means 34, 35 are operated in reciprocal step relation and with the loaded arm 36 in the vertical position V. The first folder means 34 touch and push the rear wall 6B of the blank 1, adjacent to the first lateral wall 6A and situated in the rear with respect to the forwarding direction AV, until it is arranged at right angle with respect to the first lateral wall 6A. In this way, the blank 1 is erected and assumes definitely the shape of a rectangular parallelepiped with vertical axis. On the other hand, the second folding means 35 intercept the first lower flap 5A of the blank 1, situated in the rear with respect to the forwarding direction AV, with consequent inward folding thereof by a ninety degree angle.

Afterwards, the carriage 32 is moved toward the filling station R in suitable step relation with the operation of the guiding and moving means 7, whose conveyors 7A, 7B, 7C, 7D can be e.g. inactive, until the blank 1 reaches the station R, with the first lateral protrusions 14*j*, 14*h* and the second lateral protrusions 14*k*, 14*z* arranged like in FIGS. 7A, 7B. During this stroke, the blank 1 remains aligned with the second K and the third H fixed reference planes and the second lower flap 5B, facing the first lower flap 5A and situated at the front with respect to the forwarding direction AV, touches the element 3 up to its inward folding by a ninety degree angle. The erected blank 1, with its first lower flap 5A and second lower flap 5B folded by a right angle, reaches the filling station R sliding the flaps 5A, 5B on the horizontal support plane 4 and entering the free space created by the conveyors 7A, 7B, 7C, 7D, until the front wall 6D goes in abutment against the second lateral protrusions 14*k*, 14*z* of the upper conveyors 7A, 7B. The tubular blank 1 remains in the station R for the time necessary for the introduction of articles 10 thereinto by the manipulating means 60, keeping the first lateral wall 6A and the upper transversal pre-creasing lines U always aligned with the second K and the third H reference planes, vertical and horizontal, respectively. At this point, in a given step relation, the first lateral protrusions 14*j*, 14*h* are brought to intercept the lateral back wall 6B, the gripping means 18 disengage from the first lateral wall 6A, the hopper 39 is lowered, until its lower mouth 39A is introduced into the blank 1 and the latter is filled by the manipulating means 60. The partial introduction of the hopper 39 into the erected blank 1 makes it sure that the blank maintains its erected configuration during the filling operations, preventing also the articles 10, during their introduction into the blank 1, from touching the upper flaps 5D, 5E, 5F.

The articles 10, introduced vertically by the manipulating means 60, go down to rest, during the filling step, onto the first lower flap 5A and the second lower flap 5B, as well as onto the horizontal support plane 4.

Afterwards, the lower conveyors 7C, 7D and the upper conveyors 7A, 7B are operated at the same speed: the first lateral protrusions 14*j*, 14*h* push the blank 1 in the same direction as the forwarding direction AV, while the second lateral protrusions 14*k*, 14*z*, still touching the front lateral wall 6D, cooperate with the first lateral protrusions 14*j*, 14*h* in maintaining the blank 1 erected during its sliding on the horizontal support plane 4.

During its feeding in the forwarding direction AV, the erected blank 1, loaded with articles 10, is subjected to the action of the means for folding the upper flaps, rear 5D and fore 5D, as well as the first folding means 8 and the second folding means 9. The lower lateral flaps 5C and the upper lateral flaps 5E, 5F of the passing blank strike the pair of rods of the first folding means 8 and the one 9*h*, 9*k* of the second folding means 9, respectively, with the consequent inward folding of the above flaps by a ninety degree angle. Consequently, the horizontal support plane 4 remains interposed between the first flap 5A and the second lower flap 5B and the lower lateral flaps 5C of the blank 1, without jeopardizing its forward movement.

Afterwards, the bottom and the cover of the so defined box are closed firmly by first station 12 and the second station 13, respectively. As it has already been illustrated, the closing by adhesive taping includes the application of an adhesive tape to the terminal opposite portions of the lateral flaps 5C, 5E, 5F of the blank 1. Otherwise, the strip of the adhesive tape can extend also to corresponding portions of the lateral back wall 6A and the front wall 6D of the blank 1. This is obtained with means of known type, and in particular for the taping of the blank 1 bottom, there must be at least one window made in the support plane 4 in a position corresponding to the first station 12, to allow the taping operations.

The moving of the blank 1 in the forwarding direction AV, with its bottom closed firmly, gradually slips it off the horizontal support plane 4 in correspondence to the end of the latter. The tubular blank 1, slipping off the plane 4, is placed on the roller track 17.

More than one tubular blank 1 can be placed on the horizontal plane 4 in order to increase the machine production rate. In this case, the conveyors 7A, 7B, 7C, 7D are moved with the same operation speed and, at the same time, for the whole duration of the cycle, each pair of the second lateral protrusions 14*k*, 14*z* is in advance with respect to the corresponding first pair of lateral protrusions 14*j*, 14*h*, which follows it by a distance equal to the longitudinal dimension of the blank 1 being used. This means that the blank 1, carried by the unit 2, touches the second lateral protrusions 14*k*, 14*z* already in a position corresponding to the winding ends of the conveying means 7A, 7B, 7C, 7D, reaching the filling station R at the same speed as the latter, with the first lateral protrusions 14*j*, 14*h* already touching the back wall 6A of the blank 1. At this point, the carriage 32 stops in the filling station R, to allow the manipulating means 60 to act, and at the same time the conveyors 7A, 7B, 7C, 7D are deactivated. Afterwards, when the articles 10 have been loaded into the blank 1 and the first lateral wall 6A has been disengaged from the gripping means 18, the blank 1 is pulled again by the conveyors 7A, 7B, 7C, 7D, which are, as already said, operated with the same speed, in the forwarding direction AV, for the subsequent folding and firm closing of the cover of the so obtained box-like container, as described above.

In case the size of the tubular blanks 1 is changed, each new size blank is released from the magazine 110, picked up by the slide 141, which, being in its extreme position E2, sets the above mentioned transversal pre-creasing line U (FIG. 4) always aligned with the fixed vertical reference plane Hi. Thus, the subsequent gripping of the first lateral wall 6A and its raising to rotation by a ninety degree angle with respect to the articulation axis of the arm 36 causes the alignment of the transversal pre-creasing line U, now upper, with the third fixed horizontal reference plane H, independently from the blank 1 dimensions. Obviously, also the alignment of the first lateral wall 6A with the second fixed vertical reference plane K remains unchanged for the blank 1, subjected to the gripping action of the means 18.

As already illustrated, the conveyors 7A, 7B, 7C, 7D, the horizontal support plane 4, the first folding means 8, the first closing station 12 and the roller track 17 change their space arrangement at each size change, in order to maintain the alignment of the first lateral wall 6A and the upper transversal pre-creasing line U of the blank 1, with the second K and the third H fixed reference planes, respectively, at least for the time necessary to load articles 10 into the blank dwelling in the filling station R.

The alignment of the transversal pre-creasing lines of the blank 1 with the third horizontal plane H, according to the invention, is extremely advantageous, because it allows minimizing the stroke performed by the manipulating means 60, aimed at introducing articles into the boxes being formed: actually, in case of containers of equal cross-section area and gradually decreasing height, it is noticed immediately that the filling time decreases gradually with respect to prior art, since the vertical stroke, which the manipulating means 60 must perform, decreases in proportion to the box dimensions. In this way, a proper disadvantage of the known solutions is removed, because even small boxes (that is of limited height) are now filled in satisfactory time, maintaining high production rate of the machine independently from the size in use. Still in comparison with known solutions, according to which a center line of the erected blank is aligned with a given vertical plane, the alignment, according to the present invention, of the first lateral wall 6A of the blank 1 with the second vertical plane K, allows, as it can be guessed, to minimize the transversal stroke of the manipulating means 60 at the size change, thus allowing a still higher production rate of the boxing machine.

The main advantage of the invention lies in the fact that it has conceived a boxing machine, that allows to obtain high production rate, independently from the dimensions of the blank in use, thus resolving in best way the problems mentioned in the introductory note. Actually, with respect to known solutions, the time necessary for filling the boxes being formed, in particular for small sizes, is considerably reduced, due to the systematic alignment of each blank with respect to the second K and the third H fixed reference planes, which allows to reduce the transversal and vertical stroke of the manipulating means 60.

Another advantage of the invention lies in the fact that it has conceived a machine for packaging articles in box-like containers, which is made in such a way, as to allow an operator to control visually the box-like containers being formed, filled and closed, all the time. Moreover, the particular arrangement of the conveyors 7A, 7B, 7C, 7D allows a direct access to the container and to the stations, in which the above operations are performed. Further, the machine is reliable, its structure is essential, production rate high and costs relatively low with respect to known solutions.

A still further advantage of the invention derives from the fact that the machine is fed in optimal way with the flat folded tubular blanks, independently from their shape and/or size. In particular, the conformation of the means in the feeding station is such, that their operation does not feel the effects of the particular condition, which occurs with blanks aimed at forming a square-section boxes, mentioned in the introductory note.

What has been just said is a consequence of the fact that the stack rests on a platform, and the topmost blank is picked up, consequently being in perfectly flat configuration, independently from the arrangement of the pre-creasing lines.

The layered structure of the in-depth storage magazine allows to limit the weight of each single stack to the one already predetermined by the supplying paper-transformation industry, with benefits for the operator's maneuvers as well as for the efficiency of the support offered by the oscillating support paddles, giving also a good operation autonomy. With such conception, the vertical extension of the magazine can be potentially unlimited, to increase the autonomy as much as needed, unlike the known ones, in which all the weight of the stack rests on the lower supports.

The conveying means, associated to the in-depth storage magazine, that extend toward the area occupied by the operator, allow the latter to perform, with maximum comfort, the loading of the stacks of blanks onto the rest plane, as well as their transfer therefrom to the retractable blade. According to an embodiment, the last operation can be obviously passed on to pusher means provided for this purpose.

The opposite support paddles 120, defining the support means 111, 112, 113, while rotating to open, accompany downwards the relevant stack P1, P2, P3, which consequently does not break up during the descent; in this way, the space arrangement of the stack and the centering of the relative blanks are maintained.

It is understood that what above, has been described as a not limiting example, therefore possible practical-application variants remain within the protective scope of the invention as described above and claimed below.

What is claimed is:

1. A machine for packaging articles in box-like containers, each container being obtained from a tubular blank formed by an upper sheet and a lower sheet, defining a flat folded configuration, each tubular blank having also longitudinal pre-creasing lines for facilitating folding and erection of the blank to take a substantially parallelepiped shape, as well as transversal pre-creasing lines for, in turn, facilitating folding of flaps of the container, the machine including:

an in-depth storage magazine containing at least one blank stack formed by a selected number of flat folded tubular blanks, arranged horizontally;

first openable support means for supporting said blank stack;

a vertically movable platform situated below said in-depth storage magazine for receiving, when located at a relevant raised loading position, said blank stack released by said first openable support means, said platform being subsequently lowered, together with said blank stack, to a waiting position;

picking up means, moving horizontally between two extreme positions, namely a first position defined above said blank stack resting on said platform and, in step relation with a calibrated raising of the platform, for picking up a topmost blank of said stack, followed by a platform lowering to said waiting position, and a second position define out of said platform, to deliver the topmost blank to a blank erecting station;

a mobile unit moving between said erecting station and a station for vertical introduction of said articles into erected tubular blanks (1), and aimed at erecting each tubular blank, so as to define a parallelepiped rectangular shape with a vertical axis, as well at folding, by a ninety degree angle, a first lower flap, situated backward with respect to a predetermined forwarding direction of said tubular blank toward said filling station;

a folding member, situated near the filling station for folding a second lower flap of the blank, by a ninety degree angle, opposite to said first lower flap and situated at a front side with respect to said forwarding direction, said folding being performed in time relation with blank arrival at said filling station;

a horizontal plane for supporting a tubular blank reaching said filling station and a relevant article, introduced into the blank vertically by associated manipulating means, the blank resting on said first flap and said second lower flap sliding on said horizontal plane;

guiding and moving means for guiding and moving said tubular blank along said horizontal plane in a direction concurrent to said forwarding direction, from said filling station to folding means for folding lower lateral flaps, upper fore and rear flaps, and lateral flaps of said tubular blank, as well as to stations for closing bottom and cover of a so obtained box-like container, said guiding and moving means including endless conveying means, operated by actuator means in step relation with motion of said erecting and folding unit and with vertical introduction of articles into the erected blank, said conveying means facing at least one longitudinal portion of two opposite lateral walls of the blank with respect to the forwarding direction, and having also lateral protrusions for striking corresponding portions of a blank rear wall, moving the container in the forwarding direction.

2. A machine, as claimed in claim 1, wherein said in-depth storage magazine contains a plurality of stacks of blanks, with a bottommost stack supported by said first support means and with other stacks situated at subsequent higher levels, supported by respective further openable support means, which are opened in sequence, from bottom upwards, after said bottommost stack has been loaded onto said platform, to allow each of said remaining stacks to be transferred to an immediately lower level, so as to restore presence of a stack on said first openable support means.

3. A machine, as claimed in claim 2, wherein said openable support means include a pair of opposite oscillating support paddles, moving synchronously between a horizontal position for engagement of corresponding edges of a bottommost blank of a blank stack, and a downward inclined position leaving the blanks going down maintaining an ordered arrangement.

4. A machine, as claimed in claim 2, wherein said in-depth storage magazine is delimited peripherally by adjustable walls movable according to dimensions of the blanks and in line with fixed reference lines of the machine.

5. A machine, as claimed in claim 1, wherein said picking up means include a slide in sliding engagement with a guide extending horizontally between said erecting station and the forming means of the machine, with the slide provided with a shaped arm, cantilevered toward the said platform and provided with suction cups connected to a vacuum source.

6. A machine, as claimed in claim 1, further including conveying means connected at an upper part to said in-depth storage magazine and supplying further stacks of blanks into the magazine placing the further stacks resting on the openable support means, situated at upper level.

7. A machine, as claimed in claim 6, wherein said conveying means include a support plate external with respect to said in-depth storage magazine and situated at a level suitably higher with respect to a level of an the highest openable support means for supporting at least one of said stacks of blanks, with said means including also at least a retractable blade, situated above said in-depth storage magazine in a way as to virtually continue the support plate, beneath an edge of said blank stack, the retractable blade being made to move between a work position for supporting said stack of blanks, coming from the support plate, and a rest position clear of the surface occupied by the blank stack, so as to allow the blank stack to enter, due to gravity, said in-depth storage magazine.

8. A machine, as claimed in claim 7, wherein that said support plate includes centering walls extending up to enter partially the in-depth storage magazine and suitably adjustable in relation to dimensions of the blanks and in line with said reference lines of the machine.

9. A machine, as claimed in claim 7, wherein said support plate and retractable blade extend perpendicular to the forwarding direction of said machine, with said support plate turned toward a side of the machine occupied by an operator.

10. A machine, as claimed in claim 7, wherein said support plate and retractable blade extend parallel to the forwarding direction of said machine.

11. A machine, as claimed in claim 7, wherein said retractable blade is situated at a level slightly lower than said level of the support plate.

12. A machine, as claimed in claim 8, wherein said support plate is inclined by some degrees so as to support a stack of blanks making it lean against a reference wall situated in a position corresponding to one of said reference lines.

13. A machine, as claimed in claim 1, wherein said conveying means have active runs oriented in said forwarding direction, to guide and move said tubular blank from said filling station in said forwarding direction.

14. A machine, as claimed in claim 1, wherein said conveying means have active runs oriented in the forwarding direction to guide and move said tubular blank from said filling station (in said forwarding direction, said conveying means being in a number of at least four, facing respective lower and upper longitudinal portions of said opposite lateral walls of the tubular blank.

15. A machine, as claimed in claim 1, wherein said conveying means have active runs oriented in the forwarding direction to guide and move said tubular blank from said filling station in the forwarding direction, said conveying means being in a number of at least four, facing respective lower and upper longitudinal portions of opposite lateral walls of the tubular blank, said first lateral protrusions, (moving the blank from said filling station in the forwarding direction, being connected to said lower conveyors and acting on corresponding portions of said back lateral wall of the blank;

further second lateral protrusions being connected to said upper conveyors and acting as abutment for corresponding portions of a front wall of the blank opposite to a back wall of the blank, respect to said forwarding direction, cooperating with the first protrusions to keep the tubular blank squared during transferring.

16. Machine, as claimed in claim 15, wherein at least one said lateral protrusion is associated to said conveying means, said first and second lateral protrusions of said lower conveying means and said upper conveying means being aligned in pairs with respect to separate vertical planes, so that each pair of said upper lateral protrusions is offset in the forwarding direction with respect to a pair of lower lateral protrusions, by a distance equal to the longitudinal dimension of the tubular blank, said conveying means being operated to move all at the same time and at the same speed, in step relation with vertical introduction of said articles into the blank and with operation of said erecting and folding unit.

17. Machine, as claimed in claim 16, wherein each conveying means is an endless chain operated by said actuator means and carrying said lateral protrusions, said chain being mounted onto a corresponding chain mounting element having a selected profile, integral with the machine frame during projected operation configurations, so that arrangement and extension of an active run of the chain guides and transfers said tubular blank from said filling station in said forwarding direction.

18. A machine, as claimed in claim 17, wherein said frame includes at least one work group, formed by an upper, fixed turret carrying a first vertical arm, for supporting said chain mounting element associated to said upper conveyor, the turret having in sliding engagement a first transversal stem, removably locked with respect to translation motion and carrying in turn a second vertical arm for supporting said chain mounting element associated to said upper conveyor outer with respect to the just mentioned conveyor, the group further including a lower turret adjustable in a plurality of positions included between a lowered position, corresponding to a maximum size of an erected blank with vertical axis, and a raised position corresponding to a minimum size of a blank, with said lower turret carrying a third vertical arm for supporting a chain mounting element associated to said lower conveyor, and with a second transversal arm in sliding engagement with the turret for carrying a fourth vertical arm supporting another chain mounting element associated to a lower conveyor outer with respect to the just mentioned lower conveyor, said lower turret being located, between said lowered position and said raised position, in relation to the size of the blank resting on a horizontal support plane, said horizontal plane being likewise adjustable in a plurality of positions between a lowered position and a raised position, and in combination with raising/lowering of the support plane, to align upper transversal pre-creasing lines of the blank, of a size included between said minimum and maximum sizes, with respect to a third fixed horizontal reference plane, at least until said tubular blank reaches an article filling station.

19. A machine, as claimed in claim 18, wherein said first support vertical arm and said second support vertical arm extend downwards and said third vertical arm and said fourth vertical arm extend upwards.

20. A machine, as claimed in claim 18, wherein arrangement and extension of said conveying means and associated chain mounting elements cause alignment of an inner lateral wall of the blank with a second fixed vertical reference plane, at least until said tubular blank reaches said filling station.

21. A machine, as claimed in claim 18, wherein said horizontal support plane is raised/lowered together with a folding member designed to act on a front lower flap of the blank, with respect to the forwarding direction, with first folding means for lower lateral flaps of the blank and with a first station for closing the blank bottom, the bottom being defined by said lower rear flap and by lower flaps folded inward by a ninety degree angle.

22. A machine, as claimed in claim 21, wherein said first folding means are situated downstream of said filling station with respect to said forwarding direction, for inward folding the lower lateral flaps of said tubular blank by a nearly ninety degree angle, in step relation with transferring of the blank in the forwarding direction by said guiding and moving means.

23. A machine, as claimed in claim 22, wherein said first folding means include corresponding first rods, oriented in such a way as to allow inward folding inward of lower lateral flaps of said tubular blank by a nearly ninety degree angle, at the same time with transferring of the blank in the forwarding direction, by said guiding and moving means.

24. A machine, as claimed in claim 21, further including means for folding said upper, fore and rear flaps of said tubular blank, and second folding means, situated downstream of the first folding means, with respect to the forwarding direction, for inward folding upper lateral flaps of said tubular blank by a nearly ninety degree angle, in step relation with transferring motion of the blank in the forwarding direction by said guiding and moving means.

25. A machine, as claimed in claim 24, wherein said second folding means include corresponding second rods, oriented in such a way as to inwardly fold upper lateral flaps of said tubular blank by a nearly ninety degree angle, at the same time with transferring motion of the blank in the forwarding direction, by said guiding and moving means.

26. A machine, as claimed in claim 21, further including a first station, situated downstream of the folding means (for folding lower lateral flaps of the tubular blank, erected and with its first and second lower rear and fore flaps folded inward by a ninety degree angle, with said station closing firmly the bottom of said tubular blank, as defined by the lower flaps of the blank, folded inward by a ninety degree angle.

27. A machine, as claimed in claim 26, wherein said first station includes means for mutual gluing of some portions of said lower flaps of the blank, to close firmly the blank bottom.

28. A machine, as claimed in claim 26, wherein said first station includes means for mutual adhesive taping of at least terminal opposite portions of the lower lateral flaps of the blank, to close firmly the blank bottom.

29. A machine, as claimed in claim 18, wherein said horizontal plane extends from said filling station up to at least a first station for closing firmly the blank bottom as defined by lower flaps of the blank folded inwardly by a ninety degree angle, so that the blank passing through said station in the forwarding direction, due to action of said guiding and moving means, gradually slips off the horizontal plane and is placed on a support element).

30. Machine, as claimed in claim 21, wherein said support element is a roller track.

31. Machine, as claimed in claim 1, wherein each conveying means is an endless chain operated by said actuator means and carrying said lateral protrusions, said chain being mounted onto a corresponding chain mounting element having a selected profile, integral with the machine frame during projected operation configurations, so that arrangement and extension of an active run of the chain guides and transfers said tubular blank from said filling station in said forwarding direction.

32. A machine, as claimed in claim 31, wherein said frame includes at least one work group, formed by an upper, fixed turret carrying a first vertical arm, for supporting said chain mounting element associated to said upper conveyor, the turret having in sliding engagement a first transversal stem, removably locked with respect to translation motion and carrying in turn a second vertical arm for supporting said chain mounting element associated to said upper conveyor outer with respect to the just mentioned conveyor, the group further including a lower turret adjustable in a plurality of positions included between a lowered position, corresponding to a maximum size of an erected blank with vertical axis, and a raised position corresponding to a minimum size of a blank, with said lower turret carrying a third vertical arm for supporting a chain mounting element associated to said lower conveyor, and with a second transversal arm in sliding engagement with the turret for carrying a fourth vertical arm supporting another chain mounting element associated to a lower conveyor outer with respect to the just mentioned lower conveyor, said lower turret being located, between said lowered position and said raised position, in relation to the size of the blank resting on a horizontal support plane, said horizontal plane being likewise adjustable in a plurality of positions between a lowered position and a raised position, and in combination with raising/lowering of the support plane, to align upper transversal pre-creasing lines of the blank, of a size included between said minimum and maximum sizes, with respect to a third fixed horizontal reference plane, at least until said tubular blank reaches an article filling station.

33. A machine, as claimed in claim 31, wherein arrangement and extension of said conveying means and associated chain mounting elements cause alignment of an inner lateral wall of the blank with a second fixed vertical reference plane, at least until said tubular blank reaches said filling station.

34. A machine, as claimed in claim 31, wherein said horizontal support plane is raised/lowered together with a folding member designed to act on a front lower flap of the blank, with respect to the forwarding direction, with first folding means for lower lateral flaps of the blank and with a first station for closing the blank bottom, the bottom being defined by said lower rear flap and by lower flaps folded inward by a ninety degree angle.

35. A machine, as claimed in claim 34, wherein said first folding means are situated downstream of said filling station with respect to said forwarding direction, for inward folding the lower lateral flaps of said tubular blank by a nearly ninety degree angle, in step relation with transferring of the blank in the forwarding direction by said guiding and moving means.

36. A machine, as claimed in claim 35, wherein said first folding means include corresponding first rods for inward folding lower lateral flaps of said tubular blank while transferring the blank in the forwarding direction.

37. A machine, as claimed in claim 34, further including means for folding said upper, fore and rear flaps of said tubular blank, and second folding means, situated downstream of the first folding means with respect to the forwarding direction, for inward folding upper lateral flaps of said tubular blank in step relation with transferring motion of the blank.

38. A machine, as claimed in claim 37, wherein said second folding means include corresponding second rods for inwardly folding upper lateral flaps of said tubular blank while transferring the same the blank in the forwarding direction.

39. A machine, as claimed in claim 34, further including a first station, situated downstream of the folding means (for folding lower lateral flaps of the tubular blank, erected and with its first and second lower rear and fore flaps folded inward by a ninety degree angle, with said station closing firmly the bottom of said tubular blank, as defined by the lower flaps of the blank, folded inward by a ninety degree angle.

40. A machine, as claimed in claim 31, wherein said horizontal plane extends from said filling station up to at least a first station for closing firmly the blank bottom as defined by lower flaps of the blank folded inwardly by a ninety degree angle, so that the blank passing through said station in the forwarding direction, due to action of said guiding and moving means, gradually slips off the horizontal plane and is placed on a support element).

41. A machine, as claimed in claim 1, further including a first station, situated downstream of means for folding upper lateral flaps of the tubular blank erected and with upper rear and fore flaps, folded inward by a ninety degree angle, with said station closing firmly a cover of said tubular blank defined by upper flaps of the blank folded inward by a ninety degree angle.

42. A machine, as claimed in claim 41, wherein said first station includes means for mutual gluing some portions of said upper flaps of the blank, to close firmly a blank cover.

43. A machine, as claimed in claim 41, wherein said second station includes means for adhesive taping of at least terminal opposite portions of upper lateral flaps of the tubular blank to close firmly a blank cover.

* * * * *